US008399171B2

(12) United States Patent
Hara et al.

(10) Patent No.: US 8,399,171 B2
(45) **Date of Patent: *Mar. 19, 2013**

(54) METHOD OF MANUFACTURING RESIN-LAYER COATED CARRIER, RESIN-LAYER COATED CARRIER, DEVELOPER, DEVELOPING DEVICE, AND IMAGE FORMING APPARATUS

(75) Inventors: Takashi Hara, Osaka (JP); Yoshiaki Akazawa, Osaka (JP); Yoshitaka Kawase, Osaka (JP); Yoritaka Tsubaki, Osaka (JP); Yoshinori Mutoh, Osaka (JP); Keiichi Kikawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 391 days.

This patent is subject to a terminal disclaimer.

(21) Appl. No.: 12/792,034

(22) Filed: Jun. 2, 2010

(65) Prior Publication Data

US 2010/0303506 A1 Dec. 2, 2010

(30) Foreign Application Priority Data

Jun. 2, 2009 (JP) ..... P2009-133483

(51) Int. Cl.
*G03G 5/00* (2006.01)

(52) U.S. Cl. ..... 430/137.13; 430/111.1; 430/111.3; 430/111.41; 399/252

(58) Field of Classification Search ..... 430/137.13, 430/111.1, 111.3, 111.41; 399/252
See application file for complete search history.

(56) References Cited

U.S. PATENT DOCUMENTS

| | | | | |
|---|---|---|---|---|
| 4,915,987 | A | 4/1990 | Nara et al. | |
| 5,256,511 | A | 10/1993 | Matsumura et al. | |
| 5,296,266 | A | 3/1994 | Kunugi et al. | |
| 8,236,473 | B2 * | 8/2012 | Kawase et al. | 430/137.1 |
| 2005/0282078 | A1 | 12/2005 | Kataoka et al. | |
| 2008/0014514 | A1 | 1/2008 | Kamoto | |
| 2008/0166156 | A1 | 7/2008 | Kawase | |

(Continued)

FOREIGN PATENT DOCUMENTS

| | | | |
|---|---|---|---|
| CN | 1710492 | A | 12/2005 |
| CN | 101105652 | A | 1/2008 |

(Continued)

OTHER PUBLICATIONS

Restriction Requirement mailed Mar. 12, 2012 in U.S. Appl. No. 12/605,686; 9 pages.

(Continued)

*Primary Examiner* — Mark A Chapman
(74) *Attorney, Agent, or Firm* — Nixon & Vanderhye PC

(57) ABSTRACT

A manufacturing apparatus provided with a rotary stirring section and a powder passage is used to manufacture the resin-layer coated carrier. At a fine resin particle adhering step, a magnetic base particle and a fine resin particle are inputted into the powder passage with the rotary stirring section rotating and the fine resin particle is adhered onto the surface of the magnetic base particle. At a spraying step, at least a liquid that plasticizes the fine resin particles is sprayed with spray gas from a spraying section on the magnetic base particle and the fine resin particle which are in a fluidized state in the powder passage. At a film-forming step, rotation by the rotary stirring section is continued to fluidize the magnetic base particles and the fine resin particles until the fine resin particles adhered to the magnetic base particles are softened to form a film.

13 Claims, 6 Drawing Sheets

U.S. PATENT DOCUMENTS

| | | | |
|---|---|---|---|
| 2010/0248124 | A1 | 9/2010 | Akazawa et al. |
| 2010/0303506 | A1 | 12/2010 | Hara et al. |

FOREIGN PATENT DOCUMENTS

| | | | |
|---|---|---|---|
| EP | 0 360 146 | | 3/1990 |
| JP | 64-29864 | | 1/1989 |
| JP | 64-42660 | | 2/1989 |
| JP | 1-306859 | A | 12/1989 |
| JP | 2-8860 | | 1/1990 |
| JP | 2-13969 | | 1/1990 |
| JP | 02-13972 | | 1/1990 |
| JP | 02-087167 | | 3/1990 |
| JP | 02-256073 | | 10/1990 |
| JP | 03-293676 | | 12/1991 |
| JP | 04-182665 | | 6/1992 |
| JP | 04-182669 | | 6/1992 |
| JP | 04-211269 | | 8/1992 |
| JP | 04-268572 | | 9/1992 |
| JP | 05-10971 | | 2/1993 |
| JP | 07-261447 | | 10/1995 |
| JP | 2004-082005 | A | 3/2004 |
| JP | 2004-294468 | A | 10/2004 |
| JP | 2008-191639 | A | 8/2008 |
| JP | 2008-281625 | A | 11/2008 |
| JP | 2010-281906 | | 12/2010 |

OTHER PUBLICATIONS

Notice of Allowance mailed Apr. 19, 2012 in U.S. Appl. No. 12/605,686; 14 pages.

Office Action mailed Aug. 30, 2012 in U.S. Appl. No. 12/731,396; 9 pages.

Office Action mailed Aug. 30, 2012 in U.S. Appl. No. 12/730,422; 10 pages.

U.S. Appl. No. 12/730,422, filed Mar. 24, 2010, entitled "Method of Manufacturing Toner, Toner Obtained by Method Thereof, One-Component Developer, Two-Component Developer, Developing Device and Image Forming Apparatus"; 130 pages.

* cited by examiner

METHOD OF MANUFACTURING RESIN-LAYER COATED CARRIER, RESIN-LAYER COATED CARRIER, DEVELOPER, DEVELOPING DEVICE, AND IMAGE FORMING APPARATUS

CROSS-REFERENCE TO RELATED APPLICATION

This application claims priority to Japanese Patent Application No. 2009-133483, which was filed on Jun. 2, 2009, the contents of which are incorporated herein by reference in its entirety.

BACKGROUND OF THE INVENTION

1. Field of the Invention

The present invention relates to a method of manufacturing a resin-layer coated carrier, a resin-layer coated carrier, a developer, a developing device and an image forming apparatus.

2. Description of the Related Art

With recent remarkable development of office automation equipment, image forming apparatuses such as a multi-functional peripheral, a printer and a facsimile apparatus that perform image forming processing by electrophotography have widely been spread. In an image forming apparatus employing electrophotography, a charging step, an exposure step, a developing step, a transfer step, a fixing step and a cleaning step are generally performed in order to form an image.

Specifically, firstly, a surface of a photoreceptor which is an image bearing member is uniformly charged in a dark place (the charging step), electric charges are removed by projecting signal light of a document image to the charged photoreceptor and an electrostatic charged image (electrostatic latent image) is formed on the surface of the photoreceptor (the exposure step). Then, a toner for development (hereinafter, simply referred to as "toner" unless otherwise specified) is supplied to the electrostatic charged image of the surface of the photoreceptor, a toner image as a visible image is formed (the developing step), this toner image is contacted to a recording medium such as paper and a sheet and to be performed with a corona discharge from the side opposite to the contact surface, an electric charge whose polarity is opposite to that of the toner is imparted to the recording medium, and thereby the toner image is transferred to the recording medium (the transfer step). Subsequently, the toner image on the recording medium is fixed by applying heat and pressure (the fixing step), and finally, toners left on the surface of the photoreceptor without being transferred to the recording medium is collected (the cleaning step).

An image forming apparatus employing an electrophotography forms a desired image on a recording medium by way of the above steps.

In such an image forming apparatus, a one-component developer containing only a toner or a two-component developer containing a toner and a carrier is used as a developer for developing a toner image. In the case of the two-component developer, functions including stirring, conveying and charging of toner particles are given by the carrier, and the carrier bears such functions, whereby controllability is improved compared with the one-component developer containing only a toner, and it is easy to obtain a high-quality image. Consequently, research and development of a carrier suitable for using together with a toner have been actively performed.

A carrier is composed of a core material and a coating resin, and has two basic functions of a function of stably charging a toner to a desired charge amount and a function of conveying a toner to a photoreceptor. Additionally, the carrier is stirred with a toner in a developer tank, then is conveyed onto a magnet roller, forms a magnetic brush, passes through a control blade, and returns into the developer tank again after developing the toner to be repeatedly used. In such repeated use, the carrier is required to stably exert the basic functions, especially, to stably charge a toner, in such repeated use.

Conventionally, with an aim of improving carrier characteristics of a carrier for electrophotography, surface modification processing has been performed to coat with a coating material the surface of a magnetic base particle which is a core material of the carrier. For controlling charging, mainly, coating with a resin is performed.

Typically, as methods for coating a carrier with a resin, a wet method for coating with a resin that is dissolved in a solvent and a dry method for coating with a resin particle with heat and impact force in a gas phase are used.

In many cases, resin coating of a carrier is performed by the wet method, in which specifically, an immersion coating method and a fluidized-bed spray coating method are included.

The immersion coating method is a method of immersing the magnetic base particle in a coating solution in which a coating resin is dissolved to be subjected to a coating treatment, followed by drying, however, since the magnetic base particle is immersed directly in the resin solution, it is easy to generate aggregation of the particles, and a yield of the coated carrier is significantly lowered.

The fluidized-bed spray coating method is a method of spraying a coating solution in which the coating resin is dissolved onto the surface of the magnetic base particle that is suspended in a fluidized bed (gas phase), followed by drying, however, since a solvent is used, it is easy to generate aggregation of the carriers, and the yield of the carrier is low. Further, there is also a problem such that the time required for manufacturing is long and productivity is low since a drying step is needed. Additionally, in this method, the thicker the resin coating layer is, the more the carriers aggregate, the yield is lowered, and the film thickness thus must be thinner. Therefore, such a carrier, in the case where the resin coating layer deteriorates due to long-term use, the magnetic base particle is exposed, and it is thus concerned that ability imparting charging to a toner is lowered.

For these wet methods, there is a problem that it is required to use a large amount of solvents dissolving the coating resin and environmental loads are high.

On the other hand, as a resin coating method of a carrier, a dry method without using a solvent is known (refer to Japanese Unexamined Patent Publication JP-A 2-87167 (1990)). The dry method is a coating method of causing a fine resin particle to adhere onto the surface of the magnetic base particle by mixing and stirring without using a solvent and spreading the adhered fine resin particle by plastically deforming with mechanical impact force.

According to this method, it is hard to generate aggregation of the carriers, and it is possible to obtain the resin coated carrier at a high yield even when the film thickness is thickened. Further, there is an advantage that the time required for coating is significantly shortened since the processing of cleaning, drying and the like is not necessary, and the productivity is high. Moreover, since there is no need for facilities for collecting or burning solvents, it is possible to reduce production costs.

However, the fine resin particle used for the dry method, as disclosed in JP-A 2-87167, is an acrylic resin fine particle or a styrene-acrylic resin fine particle with high charging ability, and there is a problem that these fine particles tend to have higher surface energy, therefore surface contamination of a coated carrier is easily developed by a toner particle, and the ability imparting charging of a carrier for a toner is lowered due to the toner spent with long-term use. Additionally, many of such fine resin particles to which carriers do not adhere remain so that fine powder thereof causes a charge amount to lower.

As a resin coating method of a carrier, it is possible to use a dry method of causing a fine resin particle to adhere onto the surface of the magnetic base particle by mixing and stirring without using a solvent and spreading the adhered fine resin particle by plastically deforming with mechanical impact force.

According to this method, it is hard to generate aggregation of the carriers, and it is possible to obtain the resin coated carrier at a high yield even when the film thickness is thickened. Further, there is an advantage that a step required for coating is cut since the processing of cleaning, drying and the like is not necessary. Moreover, since there is no need for facilities for collecting or burning solvents, it is possible to reduce production costs.

However, in this method, many fine particles which remain without being immobilized are on the surface of the carrier, which causes deterioration of the carrier characteristics. Additionally, there is a problem that it takes a long time to perform a process for eliminating the remaining fine particles. Therefore, in the method disclosed in JP-A 2-87167, it is needed to adjust the carrier characteristics by changing characteristics of the resin used for coating so that the selection of resins is significantly restricted.

SUMMARY OF THE INVENTION

An object of the invention is to provide a method of manufacturing a carrier particle in which an environmental load due to use of a large amount of a solvent is reduced as a problem of a wet method, and characteristic degradation as described above is eliminated that is a problem in a dry method, that is, a resin-layer coated carrier with excellent charging stability, a resin-layer coated carrier, a developer, a developing device and an image forming apparatus.

The invention provides a method of manufacturing a resin-layer coated carrier in which the resin-layer coated carrier is manufactured by stirring magnetic base particles and fine resin particles in a powder passage by using a manufacturing apparatus provided with a rotary stirring section including a rotary disc circumferentially provided with a stirring blade and a rotary shaft and the powder passage including a rotary stirring chamber and a circulation tube, comprising:

a fine resin particle adhering step of inputting the magnetic base particles and the fine resin particles into the powder passage with the rotary stirring section rotating, and adhering the fine resin particles onto a surface of the magnetic base particle;

a spraying step of spraying at least a liquid that plasticizes the fine resin particles with spray gas from a spraying section, on the magnetic base particle and the fine resin particle which are in a fluidized state in the powder passage by rotation of the rotary stirring section; and a film-forming step of continuing rotation by the rotary stirring section to fluidize the magnetic base particles and the fine resin particles until the fine resin particles adhered to the magnetic base particles are softened to form a film.

According to the invention, firstly, the fine resin particles are disintegrated to be adhered to the magnetic base particles at the fine resin particle adhering step, then the resin is plasticized by spraying a liquid at the spraying step so that uniform coating is able to be realized at the film-forming step. Further, it is possible to save the time of drying and coat for a short time by using a gasified liquid as the spray gas.

Further, in the invention, it is preferable that temperatures in the powder passage and the rotary stirring section are regulated by a temperature regulation section provided in at least a part of the powder passage so that the temperature in the powder passage is regulated to a predetermined temperature.

According to the invention, at the fine resin particle adhering step, the fine resin particle is fluidized without melting by suppressing temperature rise in the powder passage, and the fine resin particles are adhered uniformly. Additionally, at the film-forming step, the temperature in the powder passage is raised to dissolve the fine resin particle so that adhesiveness between the magnetic base particles and the coating resin is increased and it is possible to raise durability of a carrier.

Further, in the invention, it is preferable that, in the powder passage configured by connecting the circulation tube at one end and another end thereof to an inlet and an outlet of the rotary stirring chamber, respectively, the magnetic base particles and the fine resin particles are repeatedly circulated by the rotary stirring section.

According to the invention, the magnetic base particles and the fine resin particles are circulated in the powder passage to suppress local rise of temperatures, so that a coating state with uniform quality is realized, and it is possible to prevent the carrier characteristics from lowering due to unevenness of coating.

Further, in the invention, it is preferable that the rotary disc included in the rotary stirring section rotates with rotation of the rotary shaft so that the magnetic base particles and the fine resin particles being in a fluidized state are collided with the rotary disc being rotating.

According to the invention, collision energy required for forming a film of the fine resin particle is imparted by the rotary disc so that it is possible to promote the film-forming and obtain a uniform coating layer for a short time.

Further, in the invention, it is preferable that the spray gas is exhausted to an outside of the powder passage together with the gasified liquid in the powder passage.

According to the invention, the concentration of the gasified liquid which remains in the powder passage is adjusted so that fluidity of powder is prevented from lowering, and it is possible to promote the film-forming appropriately.

Further, in the invention, it is preferable that the liquid that plasticizes the fine resin particles contains at least a polar solvent.

Further, in the invention, it is preferable that the liquid that plasticizes the fine resin particles dissolves an additive component of the coating material.

Further, in the invention, it is preferable that the additive component is a charge control agent containing a polar component.

According to the invention, the charge control agent is dissolvable in the polar solvent, and thus drawn into a coating film during the spraying step to function as an additive for a coating material.

Further, the invention provides a resin-layer coated carrier which is manufactured by the method of manufacturing a carrier mentioned above.

Further, the invention provides a developer comprising the resin-layer coated carrier mentioned above.

Further, the invention provides a developer comprising the resin-layer coated carrier mentioned above and a toner, thereby constituting a two-component developer.

Further, the invention provides a developing device that performs development of a latent image formed on an image bearing member by using the developer mentioned above to form a toner image.

Further, the invention provides an image forming apparatus comprising:

an image bearing member on which a latent image is to be formed;

a latent image forming section that forms a latent on the image bearing member; and the developing device mentioned above.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
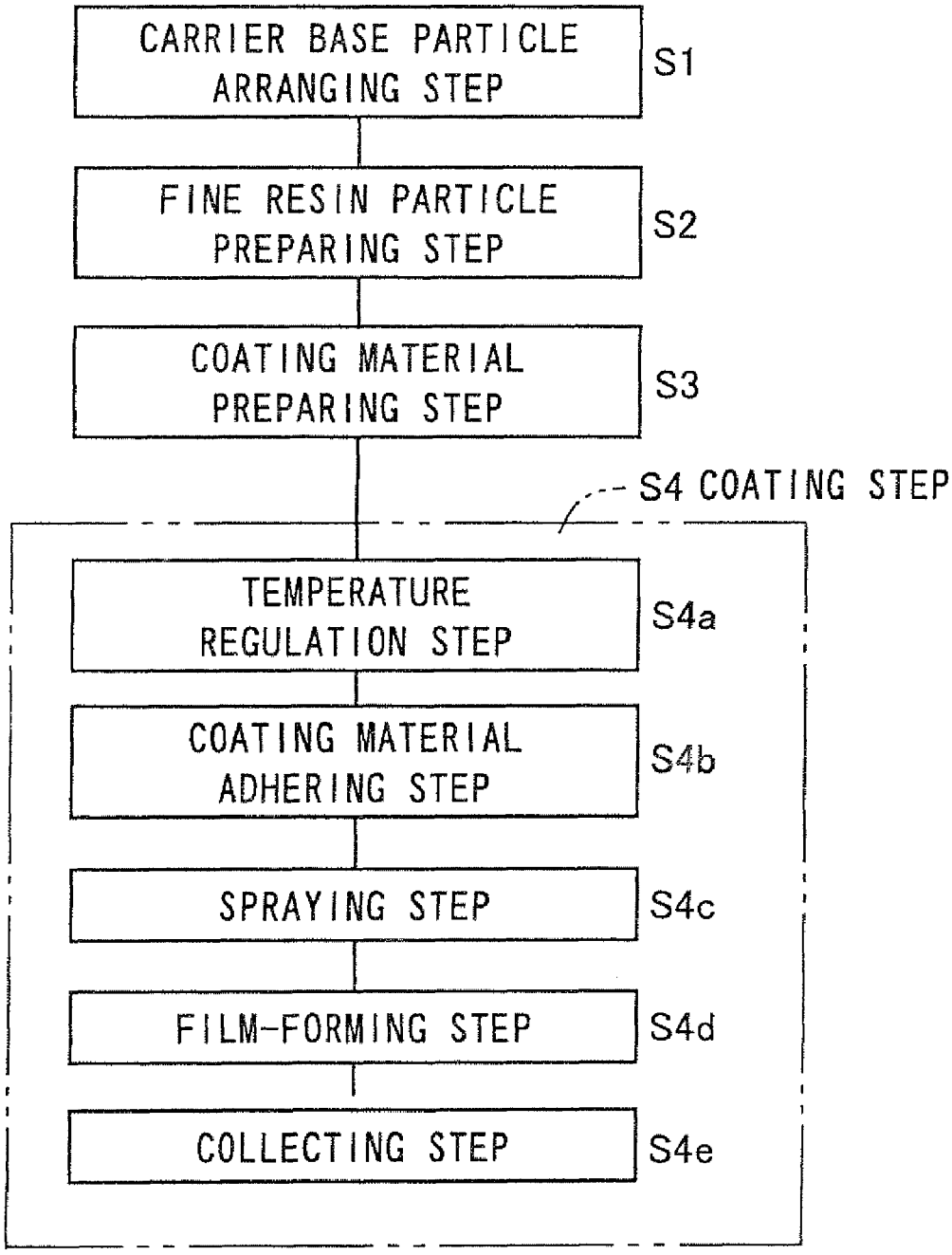
FIG. 1 is a flowchart showing an example of a procedure for a method of manufacturing a resin-layer coated carrier according to an embodiment of the invention.

Now referring to the drawings, preferred embodiments of the invention are described below.

1. Method of Manufacturing a Carrier

FIG. 1 is a flowchart showing an example of a procedure for a method of manufacturing a resin-layer coated carrier according to an embodiment of the invention. The method of manufacturing a resin-layer coated carrier of the embodiment includes a carrier base particle arranging step S1, a fine resin particle preparing step S2, a coating material preparing step S3 and a coating step S4 of coating a carrier base particle with a coating material.

For the method of manufacturing the resin-layer coated carrier according to the embodiment, a rotary stirring apparatus is used. The rotary stirring apparatus includes at least a circulating section, a temperature regulation section and a spraying section. The circulating section is composed of a rotary stirring section including a rotary disc circumferentially provided with a stirring blade and a rotary shaft, and a powder passage including a rotary stirring chamber and a circulation tube, and circulates carrier base particles and a coating material in the powder passage by the rotary stirring section. The temperature regulation section is provided at least in a part of the powder passage, and regulates temperatures in the powder passage and the rotary stirring section to a predetermined temperature. The spraying section is composed of a two-fluid nozzle, and sprays liquid and gas. The two-fluid nozzle includes a liquid tube and an air tube, the liquid tube being inserted inside the air tube so as to match axes of the two tubes, in which at least a part of those tubes are fixed so as not to be off the center.

(1) Carrier Base Particle Arranging step S1

At the carrier base particle arranging step S1, a carrier base particle to be coated with a resin layer is arranged.

As a carrier base particle, one commonly used in this field is able to be used, for example, magnetic metals such as iron, copper, nickel and cobalt; and magnetic metallic oxides such as ferrite and magnetite are included. When the carrier base particle is a magnetic material as described above, it is possible to obtain a carrier suitable for a developer used for magnetic brush developing. The carrier base particles preferably have an average particle size of 25 to 100 μm.

(2) Fine Resin Particle Preparing step S2

At the fine resin particle preparing step S2, a dried fine resin particle is prepared. Any methods may be used for drying, for example, by using a method such as hot-air heat receiving drying, conductive heat-transfer drying and microwave drying, the dried fine resin particle is able to be obtained. The fine resin particle is used as a material for forming a film on the surface of the carrier base particle at the coating step S4 below.

The fine resin particle, for example, is able to be obtained by emulsifying and dispersing a resin as a raw material of the fine resin particle with a homogenizer or the like to be refined into a fine particle. Additionally, it is also possible to obtain by polymerizing a monomer component of a resin.

As a resin used as a raw material of the fine resin particle, a resin that deforms by heating and mechanical impact force to adhere is preferred. Specifically, a styrene resin, an acrylic resin, a styrene-acrylic copolymer resin, a vinyl resin, an ethylene resin, a polyamide resin, a polyester resin and the like are used. There are mixed 20% by weight or less, preferably 10% by weight or less of them relative to the carrier base particle. As a resin of the raw material of the fine resin particle, an acrylic resin and a styrene-acrylic resin copolymer are preferably contained among the above-illustrated resins. The acrylic resin and the styrene-acrylic copolymer have many advantages such as light weight, high strength, easily obtained as inexpensive materials whose particle sizes are uniform.

Further, a softening temperature of the resin used as the raw material of the fine resin particle, although depending on conditions when a carrier is manufactured, is preferably 50° C. or more and 250° C. or less. By using the resin in such temperature range, the resin particle is spread and deformed to form a coating film so that a carrier coated with a resin layer is able to be obtained.

A volume average particle size of the fine resin particles is needed to be sufficiently smaller than an average particle size of the magnetic base particles, and is preferably 50 nm or more and 5 μm or less, and more preferably 50 am or more and 1 μm or less. When the volume average particle size of the fine resin particle is 50 nm or more and 1 μm or less, disintegration and deformation are appropriately promoted, and it is possible to form a less uneven resin coating film.

To the fine resin particle, as needed, a conductive fine particle, a charge control agent and the like may be added.

As the conductive fine particle, for example, oxides such as conductive carbon black, a conductive titanium oxide and a tin oxide are used. For expressing conductivity with a small amount of additives, carbon black and the like are preferred, however, in the case of using together with a color toner, it is concerned that carbon black is detached from a coating layer of a carrier. In such case, a conductive titanium oxide in which antimony is doped is used.

As the charge control agent, a known agent is able to be used. For example, a charge control agent used for a toner material is able to be used.

Examples of a charge control agent imparting negative chargeability include chromium azo complex dye, iron azo complex dye, cobalt azo complex dye, chromium, zinc, aluminum and boron complexes or salts of salicylic acid or its derivatives, chromium, zinc, aluminum and boron complexes or salts of naphtol acid or its derivatives, chromium, zinc, aluminum and boron complexes or salts of benzyl acid or its derivatives, long-chain alkyl carboxylates, and long-chain alkyl sulfonates.

Examples of a charge control agent imparting positive chargeability include nigrosine dye and its derivatives, triphenyl methane derivatives, derivatives of quaternary ammonium salts, quaternary phosphonium salts, quaternary pyridinium salts, guanidine salts, and amidine salts.

A content of these charge control agents is preferably in a range of 0 part by weight to 20 parts by weight based on 100 parts by weight of the fine resin particle, and more preferably in a range of 0.1 part by weight to 10 parts by weight.

Most of the charge control agents have the polarity and a good match with a polar solvent such as alcohol, and therefore, they are used in combination so that there is also a case where a further effect is able to be obtained.

(3) Coating Material Preparing Step S3

At the coating material preparing step S3, various additives such as a conductive material and a charge control agent are added to the above-described fine resin particle to be mixed, and a coating material is prepared. The fine resin particle and an additive may be inputted into the manufacturing apparatus of the carrier separately, however, in the case of enhancing the uniformity, it is desirable to mix sufficiently in advance. As a mixer, a Henschel mixer or the like commonly used is able to be used. Additionally, a part of polar substances may be dissolved in a polar solvent such as ethanol in advance to be added. As the polar solvent dissolving an additive, by using the one which hardly dissolves the fine resin particle, it is possible to prevent aggregation of carriers.

(4) Coating Step S4

<Carrier Manufacturing Apparatus>

Figure 2:
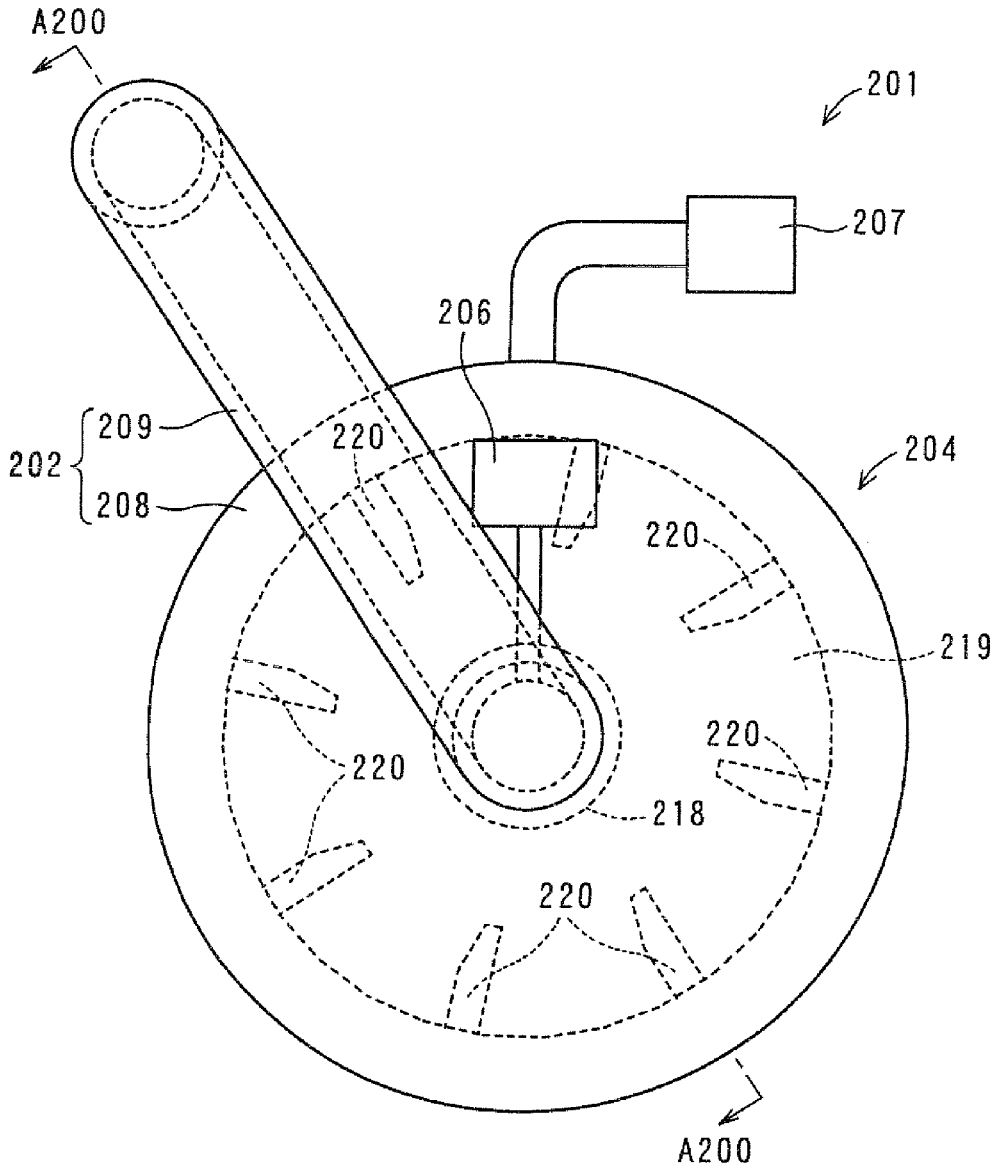
FIG. 2 is a front view of a configuration of a carrier manufacturing apparatus used for the method of manufacturing the resin-layer coated carrier according to the embodiment of the invention.
Figure 3:
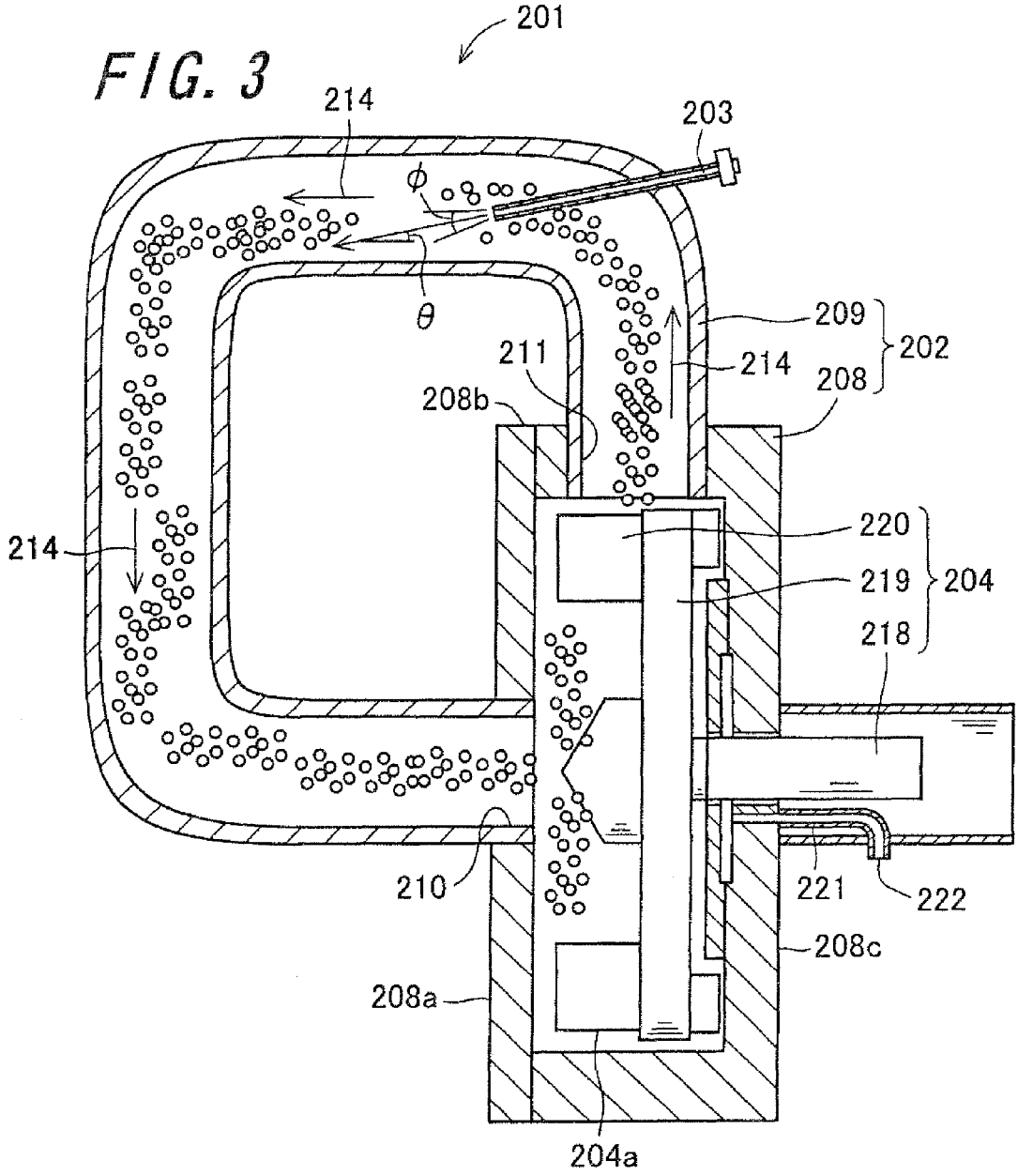
FIG. 3 is a schematic sectional view of the carrier manufacturing apparatus shown in FIG. 2 taken along the cross-sectional line A200-A200.

FIG. 2 is a front view of a configuration of a carrier manufacturing apparatus 201 used for the method of manufacturing the resin-layer coated carrier according to the embodiment of the invention. FIG. 3 is a schematic sectional view of the carrier manufacturing apparatus 201 shown in FIG. 2 taken along the cross-sectional line A200-A200. At the coating step S4, for example, by using the carrier manufacturing apparatus 201, the coating material prepared at the coating material preparing step S3 is adhered to the carrier produced at the carrier base particle arranging step S1 to form a resin film on the carrier base particle with impact force by a multiplier effect of circulation and stirring in the apparatus.

The carrier manufacturing apparatus 201 is a rotary stirring apparatus, and includes a powder passage 202, a spraying section 203, a rotary stirring section 204, a not-shown temperature regulation jacket, a powder inputting section 206, and a powder collecting section 207. The rotary stirring section 204 and the powder passage 202 constitute a circulating section.

(Powder Passage)

The powder passage 202 is composed of a stirring section 208 and a powder flowing section 209. The stirring section 208 is a cylindrical container-like member having an internal space. In the stirring section 208 which is a rotary stirring chamber, opening sections 210 and 211 are formed. The opening section 210, which is an inlet, is formed at an approximate center part of a surface 208*a* which is one side in an axial direction of the stirring section 208 so as to penetrate a side wall including the surface 208*a* of the stirring section 208 in its thickness direction. Further, the opening section 211, which is an outlet, is formed at a side surface 208*b* which is perpendicular to the surface 208*a* of the one side in the axial direction of the stirring section 208, so as to penetrate a side wall including the side surface 208*b* the stirring section 208 in its thickness direction. One end of the powder flowing section 209 as a circulation tube is connected to the opening section 210, and the other end is connected to the opening section 211. Whereby the internal space of the stirring section 208 communicates with the internal space of the powder flowing section 209, and the powder passage 202 is formed. The carrier base particle, the coating material and gas flow through the powder passage 202. The powder passage 202 is proved so that a powder flowing direction which is a direction in which the carrier base particle and the coating material flow is in a given direction.

A temperature in the powder passage 202 is set at 40° C. or higher, more preferably around a glass transition temperature of a resin, and is almost uniform at any parts by fluidity of the carrier base particles. In the case where the temperature in the passage significantly exceeds the glass transition temperature, it is easy to generate adhesion of resins locally in the apparatus, and formation of a uniform surface of a coating film is inhibited. Further, in the case where the temperature in the passage is significantly lower than the glass transition temperature, the formation of the film surface is inhibited, which causes to come off the coating material. Accordingly, it is necessary that the temperature of the powder passage 202 and the rotary stirring section 204, which will be described below, is maintained at about 40° C. to 150° C., and therefore, the temperature regulation jacket, which will be described below, whose inner diameter is larger than an external diameter of the powder passage tube is disposed at least on a part of the outside the powder passage 202 and the rotary stirring section 204.

(Rotary Stirring Section)

The rotary stirring section 204 includes a rotary shaft member 218, a discotic rotary disc 219, and a plurality of stirring blades 220. The rotary shaft member 218 is a cylindrical-bar-shaped member that has an axis matching an axis of the stirring chamber 208, that is provided so as to be inserted in a through-hole 221 which is formed to penetrate a side wall including a surface 208*c* on the other side in the axial direction of the stirring section 208 in its thickness direction, and that rotates about its axis by means of a motor (not shown). The rotary disc 219 is a discotic member having an axis supported by the rotary shaft member 218 so as to match the axis of the rotary shaft member 218 and rotating with rotation of the rotary shaft member 218. The plurality of stirring blades 220 are supported by a peripheral part of the rotary disc 219 and rotates with rotation of the rotary disc 219.

At the coating step S4, peripheral speed in the outermost periphery of the rotary stirring section 204 is preferably set at 10 m/sec or more, and more preferably 20 m/sec or more. The outermost periphery of the rotary stirring section 204 is a longest part 204*a* of the rotary stirring section 204 in a distance from the axis of the rotary stirring member 218 in a vertical direction to a direction in which the rotary shaft member 218 of the rotary stirring section 204 is extended. The peripheral speed in the outermost periphery of the rotary stirring section 204 is set at 20 m/sec or more so that it is possible to fluidize the carrier base particle isolatedly. When the peripheral speed in the outermost periphery is less than 10 m/sec, it is impossible to fluidize the carrier base particle and the coating material isolatedly, and the carrier base particle is thus not able to be coated uniformly with the resin film.

The carrier base particle and the coating material preferably collide with the surface of the rotary disc 219 in a vertical direction. This makes it possible to stir the carrier base particle and the coating material sufficiently and coat the carrier base particle with the coating material more uniformly, and to further improve yield of the carrier with the uniform coating layer.

(Spraying Section)

The spraying section 203 is provided so as to be inserted in an opening formed on an outer wall of the powder passage 202 and is provided, in the powder flowing section 209, on the powder flowing section which is on the closest side to the opening section 211 in the flowing direction of the carrier base particle and the coating material. The spraying section 203 includes a liquid reservoir for reserving a liquid, a carrier gas supplying section for supplying carrier gas, and a two fluid nozzle for mixing the liquid and the carrier gas, ejecting the obtained mixture to the toner base particles present in the powder passage 202, and spraying droplets of the liquid to the carrier base particles. The two-fluid nozzle is provided as being inserted to the opening formed on the outer wall of the powder passage 202. The liquid is fed to the spraying section 203 by a liquid feeding pump with a constant flow rate to be sprayed and gasified by the spraying section 203, and the gasified liquid is spread on the surface of the carrier base particles and the fine resin particles. Thereby, the coating material is plasticized.

(Temperature Regulation Jacket)

A temperature regulation jacket (riot shown) that is a temperature regulation section is provided at least in a part on the outside of the powder passage 202, and temperature in the powder passage 202 and the rotary stirring section 204 is regulated at a predetermined temperature by passing a cooling medium or a heating medium through an internal space of the jacket. This makes it possible to control temperature of the outside in the powder passage and the rotary stirring section to not higher than such temperature that the coating material is not deformed by softening. Additionally, at the spraying step S4*c* and the film-forming step S4*d*, variation in temperatures of the carrier base particle, the coating material and the liquid is able to be reduced so that it is possible to maintain a stable fluidized state.

Although the carrier base particle and the coating material generally collide with the inner wall of the powder passage many times, a part of the collision energy is converted into the thermal energy at that time and is accumulated in the carrier base particle and the coating material. As the number of the collision increases, the thermal energy accumulated in those particles increases and then the coating material is softened to be adhered to the inner wall of the powder passage. By providing the temperature regulation jacket over the entire outside of the powder passage 202, the temperature in the apparatus is prevented from rising sharply, softening of the coating material is suppressed, and it is possible to prevent adhesion of the carrier base particle and the coating material to the inner wall of the powder passage 202 reliably and to avoid that the inside of the powder passage is narrowed. As a result, the carrier base particle is coated with the coating material uniformly and it is possible to manufacture a carrier particle without characteristic degradation in high yield.

Further, inside the powder flowing section 209 which lies downstream of the spraying section 203, the sprayed liquid remains without being dried, and the liquid is easily accumulated due to delay of a drying speed when the temperature is inappropriate. When the carrier base particle contacts with such liquid, the carrier base particle easily adheres to an inner wall 210 of the powder passage 202, which causes generation of aggregation of the carrier. On an inner wall near the opening section 210, the carrier base particle that flows from the powder flowing section 209 into the stirring section 208 collides with the carrier base particle that flows inside the stirring section 208 by the rotary stirring section 204 so that the carrier base particles easily adhere to the vicinity of the opening section 210. The temperature regulation jacket is provided in a part to which such carrier base particles easily adhere, whereby it is possible to prevent the carrier base particles from adhering to the inner wall of the powder passage 202 more reliably.

(Powder Inputting Section and Powder Collecting Section)

Figure 4:
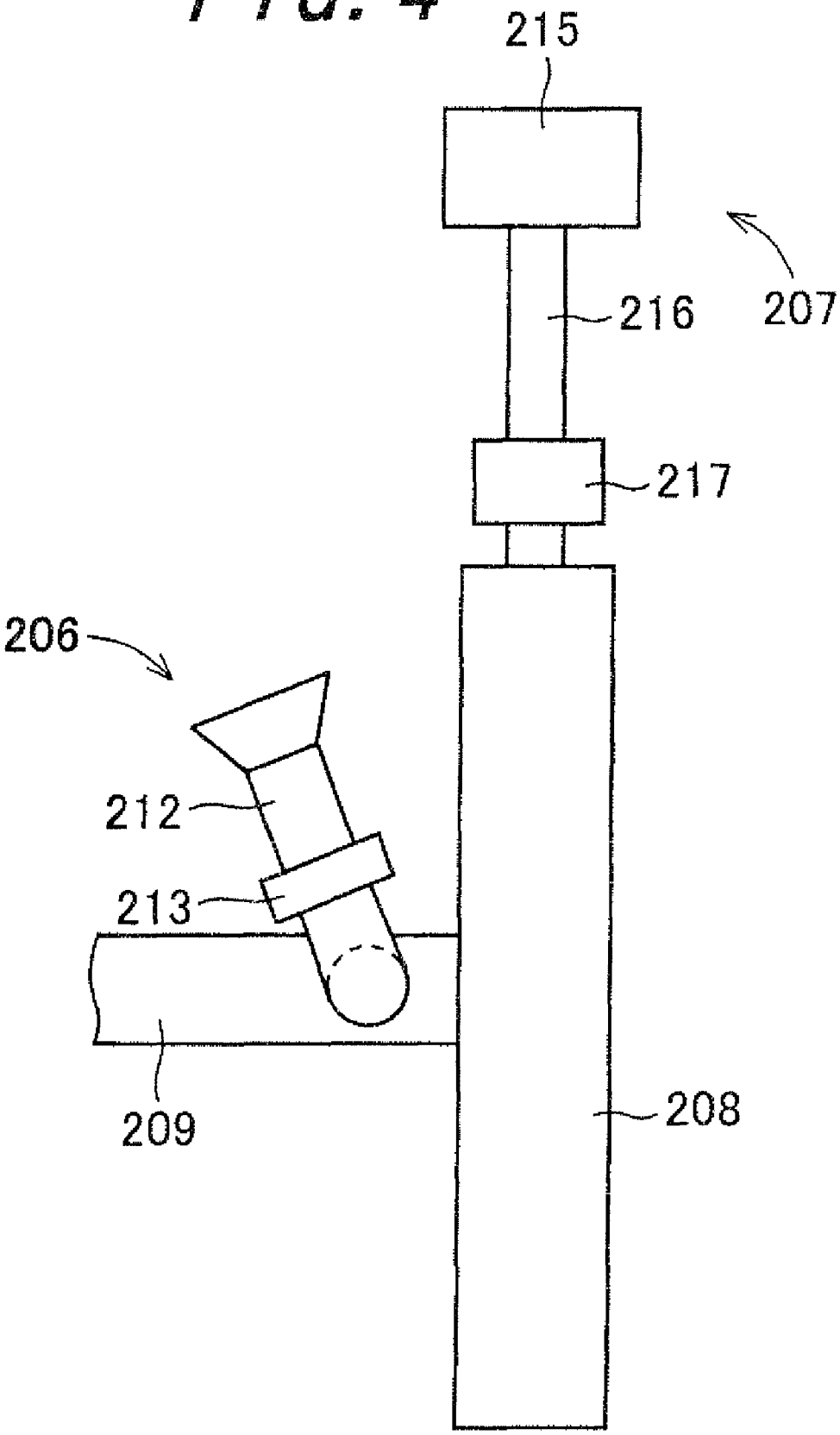
FIG. 4 is a front view showing a configuration around the powder inputting section and the powder collecting section.

To the powder flowing section 209 of the powder passage 202, a powder inputting section 206 and a powder collecting section 207 are connected. FIG. 4 is a front view showing a configuration around the powder inputting section 206 and the powder collecting section 207.

The powder inputting section 206 includes a hopper (not shown) that supplies the carrier base particle and the coating material, a supplying tube that communicates the hopper with the powder passage 202 and a solenoid valve 213 provided in the supplying tube 212. The carrier base particle and the coating material supplied from the hopper are supplied to the powder passage 202 through the supplying tube 212 in a state where the flowing passage in the supplying tube 212 is opened by the solenoid valve 213. The carrier base particle and the coating material supplied to the powder passage 202 flow in a given direction by the rotary stirring section 204. Additionally, in a state where the flowing passage in the supplying tube 212 is closed by the solenoid valve 213, the carrier base particle and the coating material are not supplied to the powder passage 202.

The powder collecting section 207 includes a collecting tank 215, a collecting tube 216 that communicates the collecting tank 215 with the powder passage 202, and an electromagnetic valve 217 provided in the collecting tube 216. The carrier particles flowing through the powder passage 202 are collected in the collecting tank 215 through the collecting tube 216 in a state where the passage in the collecting tube 216 is opened by the electromagnetic valve 217. Moreover, the carrier particles flowing through the powder passage 202 are not collected in a state where the passage in the collecting tube 216 is closed by the electromagnetic valve 217.

The coating step S4 using the carrier manufacturing apparatus 201 as described above includes a temperature regulation step S4*a*, a coating material adhering step S4*b*, a spraying step S4*c*, a film-forming step S4*d* and a collecting step S4*e*.

(4)-1. Temperature Regulation step S4*a*

At the temperature regulation step S4*a*, while the rotary stirring section 204 is rotated, temperatures in the powder passage 202 and the rotary stirring section 204 are regulated to a predetermined temperature by passing the medium through the temperature regulation jacket disposed the outside thereof. This makes it possible to control the temperature in the powder passage 202 to not higher than such temperature that the coating material to be inputted in the coating material S4*b* described below is not fused and adhered to a pipe and the apparatus.

At this step, temperatures of not only a part in the powder passage 202 but also the entire inside of the powder passage 202 and the rotary stirring section 204 are preferably regulated. Thereby, adhesion and film-forming of the coating material to the carrier base particle are promoted smoothly, comparing to the case where only a temperature of a part of the powder passage is regulated. Additionally, since it is possible to suppress adhesion of these particles to the wall surface inside the powder passage, it is possible to prevent the inside of the powder passage from being narrow. As a result, the carrier base particle is coated with the coating material uniformly and it is possible to manufacture a carrier whose state of the film and particle size distribution are uniform stably over the long term.

(4)-2. Fine Resin Particle Adhering Step S4*b*

At the fine resin particle adhering step S4*b*, in a state where the rotary stirring section rotates, the carrier base particles and the coating material are supplied from the powder inputting section 206 to the powder passage 202.

The carrier base particles and the coating material supplied from the powder passage 202 are stirred by the rotary stirring section 204 to flow in the direction of an arrow 214 through the powder flowing section 209 of the powder passage 202. Thereby, the coating material adheres to the surface of the carrier base particle.

(4)-3. Spraying Step S4*c*

At the spraying step S4*c*, to the carrier base particles and the coating material being in a fluidized state, a liquid which does not dissolve the coating material and has an effect to plasticize is sprayed with carrier gas from the above-described spraying section 203.

The sprayed liquid is gasified so that a gas concentration inside of the powder passage 202 is constant and the gasified liquid is preferably exhausted outside the powder passage through the through-hole 221. The concentration of the gasified liquid is kept constant so that the drying speed of the liquid is made higher comparing to the case where the concentration is not kept constant. Therefore, it is possible to prevent that the carrier particles in which an undried liquid remains are adhered to each other and to suppress aggregation of the carrier particles. As a result, it is possible to further improve yield of the carrier with a uniform coating layer.

The concentration of the gasified liquid measured by a concentration sensor in a gas exhausting section 222 is preferably about 3% or less. When the concentration is about 3% or less, the drying speed of the liquid is made sufficiently larger, and the carrier base particles remaining in the undried liquid are prevented from adhering each other so that aggregation of the carrier base particles is able to be prevented. Moreover, the concentration of the gasified liquid is more preferably 0.1% or more and 3.0% or less. In a case where the concentration of the gasified liquid falls within this range, it is possible to prevent aggregation of the carrier base particles without lowering the productivity. The concentration of the gasified liquid is adjusted according to a type and a volume of the raw material of the carrier base particle and the coating material. Additionally, adjustment is also able to be made by changing a spraying speed of the liquid according to the scale of the carrier manufacturing apparatus 201.

In the embodiment, it is preferred that spraying is started after flowing speeds of the carrier base particle and the coating material in the powder passage 202 are stabilized. This makes it possible to spray liquid to the carrier base particle and the coating material uniformly and to improve yield of the carrier with a uniform coating layer.

(Carrier Gas)

For the carrier gas, compressed air and the like are usable. A flow rate of the carrier gas is adjusted as appropriate according to the spraying speed of the liquid. A preferred flow rate of the carrier gas depends on the spraying speed of the liquid and is different depending on the scale of the carrier manufacturing apparatus 201 and the amounts of the carrier base particles and the coating material.

An angle θ formed by a liquid spraying direction that is the axial direction of the two-fluid nozzle of the spraying section 203 and a powder flowing direction that is the direction in which the carrier base particle and the coating material flow in the powder passage 202 is preferably 0° or more and 45° or less. In the case where the angle θ falls within this range, the droplet of the liquid is prevented from recoiling from the inner wall of the powder passage 202 and a yield of the carrier base particle coated with a resin film is able to be further improved. In the case where the angle θ exceeds 45°, the droplet of the liquid easily recoils from the inner wall of the powder passage 202 and the spray liquid is easily retained, thus aggregation of the carrier particles are generated and the yield is deteriorated.

A spreading angle ϕ of the liquid sprayed by the spraying section 203 is preferably 20° or more and 90° or less. In the case where the spreading angle ϕ is off this range, uniform spray of the liquid to the carrier base particle may be difficult.

At this step, by using the above-described structured two-fluid nozzle, even when circulating air, the carrier base particles and the coating material that are circulating collide with the two-fluid nozzle, it is possible to prevent the centers of the liquid tube and the air tube from moving. This makes it possible to keep the direction of the liquid to be sprayed and the spray amount constant with the amount per unit area of the carrier gas to be sprayed being constant so that a state of spraying is maintained stably. Therefore, the concentration of the gasified liquid in the powder passage is kept constant and it is possible to manufacture a carrier whose state of the film and particle size distribution are uniform stably over the long term.

(4)-4. Film-Forming Step S4*d*

At the film-forming step S4*d*, rotation of the rotary stirring section 204 is continued at a predetermined temperature to fluidize the carrier base particles and the coating material until the coating material is softened to form a film, thereby the carrier base particle is coated with the coating material.

(4)-5. Collecting Step S4*e*

At the collecting step S4*e*, the liquid spray from the spraying section and rotation of the rotary stirring section 204 are stopped, the resin-layer coated carrier is ejected outside the apparatus from the powder collecting section 207 to be collected.

Such a carrier manufacturing apparatus 201 is not limited to the above-described configuration but allowed to have various changes. For example, the temperature regulation jacket may be provided on the entire surface of the outside of the powder flowing section 209 and the stirring section 208, and may be provided in a part of the outside of the stirring section 208 or the powder flowing section 209. When the temperature regulation jacket is provided on the entire surface of the outside of the powder flowing section 209 and the stirring section 208, it is possible to prevent adhesion of the carrier base particle to the inner wall of the powder passage 202 more reliably.

Further, the carrier manufacturing apparatus is also able to be configured with a combination of a commercially-available stirring apparatus and the spraying section. The commercially-available stirring apparatus provided with the powder passage and the rotary stirring section includes, for example, a Hybridization system (trade name, manufactured by Nara Machinery Co., Ltd.). A liquid spray unit is installed inside such stirring apparatus, thus it is possible to use this stirring apparatus as a carrier manufacturing apparatus used for manufacturing carriers of the invention.

2. Carrier

The carrier according to an embodiment of the invention is manufactured by the above-described method of manufacturing carriers. Since the carrier obtained by the above-described method of manufacturing carriers has a uniform coating amount of the coating material, the carrier characteristics such as charging characteristics are uniform between the individual carrier particles. Thus, by using a toner containing such carriers for image formation, it is possible to obtain an image with high definition and high image quality without unevenness in density for a long term.

A particle of the carrier preferably has a spherical shape or flattened shape. A particle size of the carrier is not limited to a particular diameter, and in consideration of forming higher-quality images, the particle size of the carrier is preferably 10 μm to 100 μm and more preferably 20 μm to 50 μm.

The resistivity of the carrier is preferably $10^8$ Ω·cm or more, and more preferably $10^{12}$ Ω·cm or more. The volume resistivity of the carrier is measured as follows.

At the outset, the carrier particles are put in a container having a cross section of 0.50 $cm^2$, thereafter tapped. Subsequently, a load of 1 $kg/cm^2$ is applied to the carrier particles which are held in the container as just stated. When an electric field of 1,000 V/cm is generated between the weight and a bottom electrode of the container by application of voltage, a current value is obtained. Based on the current value the resistivity of the carrier is determined. When the resistivity is low, the carrier will be charged upon application of bias voltage to the developing sleeve, which causes the carrier particles to be more easily attached to the photoreceptor. Further, breakdown of bias voltage is more liable to occur.

Magnetization intensity (maximum magnetization) of the carrier is preferably 10 emu/g to 60 emu/g and more preferably 15 emu/g to 40 emu/g. Under the condition of magnetic flux density of an ordinary developing roller, no magnetic binding force works on the carrier having magnetization intensity less than 10 emu/g, which may cause the carrier to scatter. The carrier having magnetization intensity more than 60 emu/g has bushes which are too large to keep the non-contact state of the toner with an image bearing member in a non-contact development. Further, sweeping streaks may be easily appeared on a toner image in a contact development.

3. Developer

The resin-layer coated carrier of the invention is mixed with a toner to be used as a two-component developer. The carrier of the invention whose carrier characteristics such as charging characteristics between individual carrier particles are uniform, becomes a developer whose toner characteristics are uniform so that it is possible to form an image with high definition and high image quality without unevenness in density stably.

<Toner>

A toner is not particularly limited, and a known toner is usable therefor. The toner contains a colored resin particle and an external additive adhering to the surface of the colored resin particle as needed, and for example, by mixing them with use of an air mixer such as a Henschel mixer, that is, by performing external processing, is able to be produced.

(Colored Resin Particle)

A colored resin particle is able to be produced by a known method such as a kneading-pulverizing method and a polymerization method.

In production of the colored resin particle by the kneading-pulverizing method, a binder resin, a colorant, a charge control agent, a release agent and other additives are mixed by a mixer such as HENSCHELMIXER, SUPERMIXER, MECHANOMILL and a Q-type mixer. The mixture of the raw materials is melt-kneaded by a kneader such as a twin-screw kneader or a single-screw kneader at a temperature of 100 to 180° C., the obtained kneaded product is cooled and solidified, and the solidified product is pulverized by an air pulverizer such as a jet mill. For the pulverized product obtained in this manner, particle size adjustment such as classification is performed as needed, and the colored resin particle is obtained.

Examples of the binder resin include a styrene-acrylic resin, an acrylic resin, and a polyester resin which are known. Among them, a linear or non-linear polyester resin is particularly preferred. A polyester resin is excellent in providing mechanical strength (fine powder is hard to be generated), fixability (hard to separate from paper after fixation) and resistance to hot offset at the same time.

The polyester resin is able to be obtained by polymerizing a monomer composition composed of divalent or higher-valent polyalcohol and divalent or higher-valent polybasic acid.

Examples of the divalent alcohol include: dials such as ethylene glycol, diethylene glycol, triethylene glycol, 1,2-propylene glycol, 1,3-propylene glycol, 1,4-butane diol, neopentyl glycol, 1,4-butane dial, 1,5-pentane dial and 1,6-hexane dial; alkylene oxide adducts of bisphenol A such as bisphenol A, hydrogenated bisphenol A, polyoxyethylene bisphenol A, polyoxy propylene bisphenol A and the like; and others.

Examples of divalent polybasic acid include: maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid and anhydrides and low alkyl esters of these acids, alkenyl succinic acids or alkyl succinic acids such as n-dodecenyl succinic acid, and n-dodecyl succinic acid.

Further, trivalent or higher-valent polyalcohol or trivalent or higher-valent polybasic acid may be added, as needed.

Examples of trivalent or higher-valent polyalcohol include sorbitol, 1,2,3,6-hexane tetrol, 1,4-solbitane, pentaerythritol, dipentaerythritol, tripentaerythritol, sucrose, 1,2,4-butanetriol, 1,2,5-pentanetriol, glycerol, 2-methyl propanetriol, 2-methyl-1,2,4-butanetriol, trimethylol ethane, trimethylol propane, 1,3,5-trihydroxy methyl benzene and others.

Examples of trivalent or higher-valent polybasic acid include 1,2,4-benzenetricarboxylic acid, 1,2,5-benzene-tricarboxylic acid, 1,2,4-cyclohexanetricarboxylic acid, 2,5,7-naphthalenetricarboxylic acid, 1,2,4-naphthalene-tricarboxylic acid, 1,2,5-hexanetricarboxylic acid, 1,3-dicarboxyl-2-methyl-2-methylene-carboxypropane, tetra (methylene carboxyl) methane, 1,2,7,8-octane tetracarboxyl acid, and anhydrides of these.

As the colorant, known pigments and dye that are commonly used for a toner are able to be used.

Examples of usable black colorant include carbon black and magnetite.

Examples of usable yellow colorant include: acetoacetic arylamide monoazo yellow pigment such as C.I Pigment Yellow 1, C.I Pigment Yellow 3, C.I Pigment Yellow 74, C.I Pigment Yellow 97 and C.I Pigment Yellow 98; acetoacetic arylamide disazo yellow pigment such as C.I. Pigment Yellow 12, C.I Pigment Yellow 13, C.I Pigment Yellow 14 and C.I Pigment Yellow 17; condensed monoazo yellow pigment such as C.I. Pigment Yellow 93 and C.I Pigment Yellow 155; other yellow pigments such as C.I. Pigment Yellow 180, C.I Pigment Yellow 150 and C.I Pigment Yellow 185; and yellow dye such as C.I. Solvent Yellow 19, C.I. Solvent Yellow 77, C.I. Solvent Yellow 79 and C.I. Disperse Yellow 164.

Examples of usable red colorant include: C.I. Pigment Red 48, C.I. Pigment Red 49:1, C.I. Pigment Red 53:1, C.I. Pigment Red 57, C.I. Pigment Red 57:1, C.I. Pigment Red 81, C.I. Pigment Red 122, C.I. Pigment Red 5, C.I. Pigment Red 146, C.I. Pigment Red 184, C.I. Pigment Red 238; red or bright red pigment such as C.I. Pigment Violet 19; red dye such as C.I. Solvent Red 49, C.I. Solvent Red 52, C.I. Solvent Red 58, and C.I. Solvent Red 8.

Examples of usable blue colorant include: blue dye and pigment of copper phthalocyanine and its derivatives such as C.I. Pigment Blue 15:3 and C.I. Pigment Blue 15:4; and green pigment such as C.I. Pigment Green 7 and C.I. Pigment Green 36 (phthalocyanine green).

The content of the colorant is preferably about 1 to 15 parts by weight, and more preferably in a range of 2 to 10 parts by weight, based on 100 parts by weight of the binder resin.

As the charge control agent, a known charge control agent is able to be used.

Examples of the charge control agent for imparting negative chargeability include: chromium azo complex dye, iron azo complex dye, cobalt azo complex dye, chromium, zinc, aluminum and boron complexes or salts of salicylic acid or its derivatives, chromium, zinc, aluminum and boron complexes or salts of naphtol acid or its derivatives, chromium, zinc, aluminum and boron complexes or salts of benzyl acid or its derivatives, long-chain alkyl carboxylates, and long-chain alkyl sulfonates.

Examples of the charge control agent for imparting positive chargeability include: nigrosine dye and its derivatives, triphenyl methane derivatives, derivatives of quaternary ammonium salts, quaternary sulfonium salts, quaternary pyridinium salts, guanidine salts, and amidine salts.

The content of these charge control agents is preferably in a range of 0.1 to 20 parts by weight, and more preferably in a range of 0.5 to 10 parts by weight, based on 100 parts by weight of the binder resin.

Examples of the releasing agent include: petroleum wax including synthesized wax such as polypropylene and polyethylene; paraffin wax and its derivatives; and microcrystalline wax and its derivatives, and its modified wax, and plant-derived wax such as carnauba wax, rice wax and candelilla wax. Containing these releasing agents in the toner makes it possible to improve a mold-releasing property of the toner for the fixing roller or fixing belt, thus prevent high-temperature and low-temperature offset during fixing of the toner. An additive amount of the releasing agent is not particularly limited, and is generally 1 part by weight or more and 5 parts by weight or less, based on 100 parts by weight of the binder resin.

A volume average particle size of the colored resin particle is preferably in a range of 5 to 7 μm. When it is in this range, it is possible to obtain an image excellent in a dot reproduction with less fogging and less toner scattering, and high definition.

(External Additive)

An external additive prevents aggregation of a toner, and is preferably contained in the toner in order to prevent lowering of a transfer effect of the toner from the photoreceptor drum to a recording medium.

As the external additive, an inorganic particle with a 7 to 100 nm average particle size made of silica, titanium oxide, alumina or the like is usable. Additionally, these inorganic particles may be imparted with hydrophobicity by applying the surface treatment with a silane coupling agent, a titanium coupling agent or silicone oil. The inorganic particle to which hydrophobicity is imparted has less reduction of electric resistance and a charge amount under high humidity. Especially, a silica particle in which a trimethylsilyl group is introduced on the surface by using hexamethyldisilazane as the silane coupling agent is excellent in hydrophobicity and insulation properties. A toner in which such silica particle is externally added is able to maintain excellent chargeability even under a high-humidity environment.

Examples of the external additive include: Aerosil 50 (number-average particle size: about 30 nm), Aerosil 90 (number-average particle size: about 30 nm), Aerosil 130 (number-average particle size: about 16 nm), Aerosil 200 (number-average particle size: about 12 nm), Aerosil 300 (number-average particle size: about 7 nm) and Aerosil 380 (number-average particle size: about 7 nm) manufactured by Japan Aerosil Co., Ltd., Aluminum Oxide C (number-average particle size: about 13 nm), titanium oxide P-25 (number-average particle size: about 21 nm) and MOX 170 (number-average particle size: about 15 nm) manufactured by Degussa AG, Germany, TTO-51 (number-average particle size: about 20 nm) and TTO-55 (number-average particle size: about 40 nm) manufactured by Ishihara Sangyo Co., Ltd., silica (number-average particle size: about 115 nm) and (number-average particle size: about 85 nm) manufactured by Cabot Corporation, and Silica X-24 (number-average particle size: about 110 nm) manufactured by Shin-Etsu Chemical Co., Ltd.

The additive amount of the external additive is preferably 0.2 to 3% by weight. When it is less than 0.2% by weight, sufficient fluidity is not imparted to a toner in some cases, and when it exceeds 3% by weight, fixability of the toner is sometimes lowered.

A usage proportion of the toner and the carrier in the two-component developer is not particularly limited, and is selectable as appropriate depending on a type of a toner and a carrier, however, in the case of the resin-layer coated carrier (density of 5 to 8 g/cm$^2$), in the developer, a toner may be used so that 2 to 30% by weight, preferably 2 to 20% by weight of a toner, based on a total amount of the developer is contained. Furthermore, in the two-component developer, coverage of the carrier with the toner is preferably 40 to 80%.

4. Image Forming Apparatus

Figure 5:
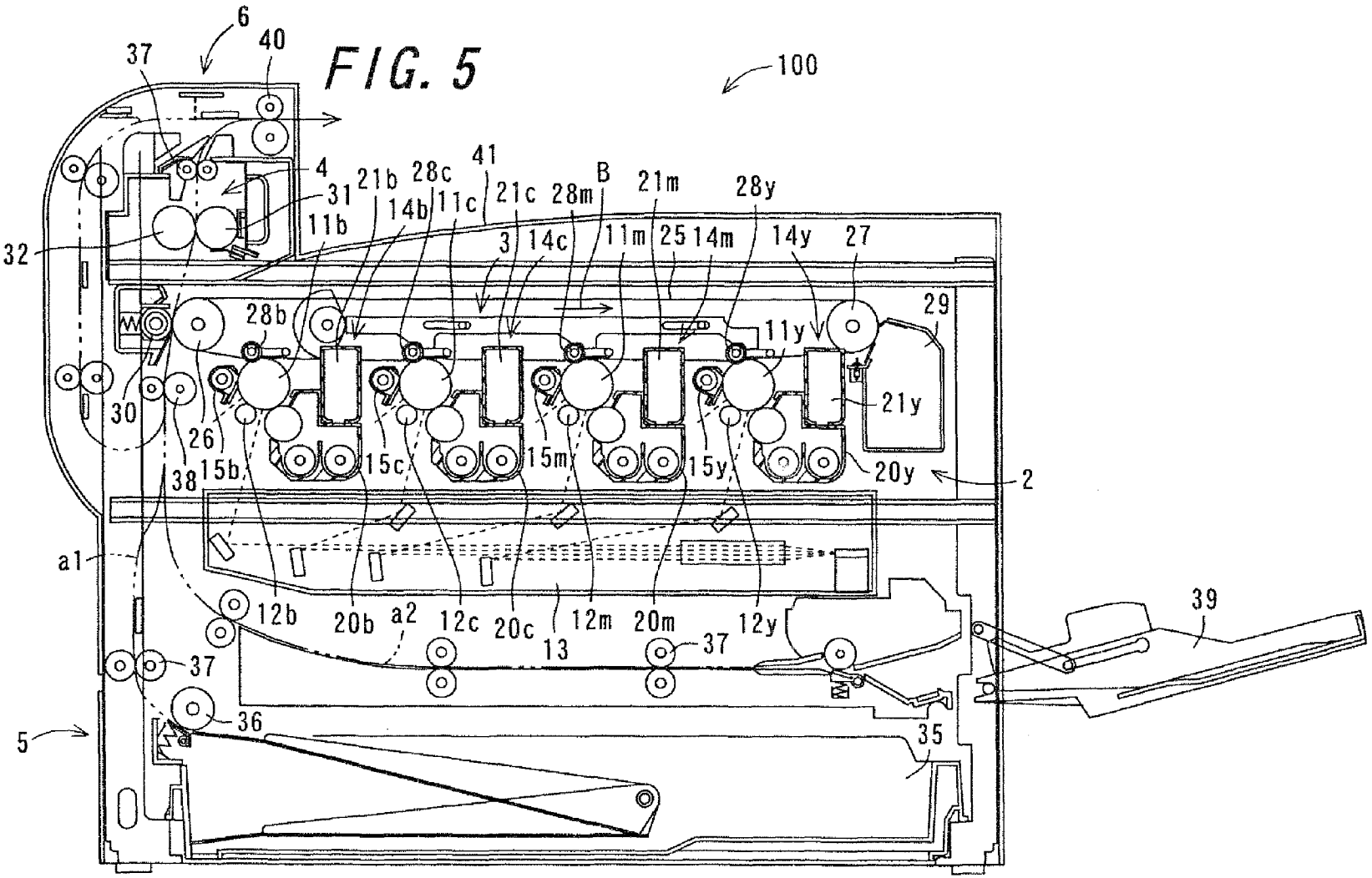
FIG. 5 is a sectional view schematically showing a configuration of an image forming apparatus according to an embodiment of the invention.

FIG. 5 shows a configuration of an image forming apparatus 100 according to an embodiment of the invention. The image forming apparatus 100 is a multi-functional peripheral having combination of a copy function, a printer function and a facsimile function, and forms a full-color or monochrome image on a recording medium in accordance with transferred image information. That is, the image forming apparatus 100 has three types of a print mode including a copier mode (copy mode), a printer mode and a FAX mode, and responds to reception of a print job from an external device using an operation input from a operation section (not shown), a personal computer, a mobile terminal apparatus, an information recording storage medium or a memory device so that a print mode is selected by a control unit (not shown).

The image forming apparatus 100 includes a photoreceptor drum 11 which is an image bearing member, an image forming section 2, a transfer section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the toner image forming section 2 and some parts of the components contained in the transfer section 3. Herein, the four sets of respective components provided for the respective colors are distinguished by giving alphabets indicating the respective colors to the end of the reference numerals, and in a case where the sets are collectively referred to, only the reference numeral is shown.

The photoreceptor drum 11 is a roller-like member provided so as to be capable of being rotationally driven around an axis thereof by a rotary driving section (not shown) and on the surface thereof an electrostatic latent image is formed. The rotary driving section of the photoreceptor drum 11 is controlled by a control unit that is realized by a central processing unit (CPU). The photoreceptor drum 11 comprises a conductive substrate (not shown), and a photosensitive layer (not shown) formed on the surface of the conductive substrate.

The conductive substrate may be in various shapes including a cylindrical shape, a columnar shape, or a thin film sheet shape, for example. Among them, the cylindrical shape is preferable. The conductive substrate is formed of a conductive material.

As the conductive material, those customarily used in the relevant field can be used including, for example, a metal such as aluminum, copper, brass, zinc, nickel, stainless steel, chromium, molybdenum, vanadium, indium, titanium, gold, and platinum; alloy formed of two or more of the metals; a conductive film in which a conductive layer containing one or two or more of aluminum, aluminum alloy, tin oxide, gold, indium oxide, etc. is formed on a film-like substrate such as a synthetic resin film, a metal film, and a paper sheet; and a resin composition containing conductive particles and/or conductive polymer. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer and a charge transporting layer on the surface of the conductive substrate. In this case, an undercoat layer is preferably formed between the conductive substrate and the charge generating layer or the charge transporting layer. The undercoat layer covers the flaws and irregularities present on the surface of the conductive substrate, leading to a smooth surface of the photosensitive layer. Whereby, chargeability of the photosensitive layer can be prevented from degrading during repetitive use, and the chargeability of the photosensitive layer under a low temperature circumstance and/or a low humidity circumstance can be enhanced. Further, the photosensitive layer may have a highly-durable three-layer structure having a photoreceptor surface-protecting layer provided as the top layer.

The charge generating layer contains as a main substance a charge generating substance that generates charges under irradiation of light, and contains known binder resin, a plasticizer, a sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanine, and halogenated non-metal phthalocyanine; squalium dye; azulenium dye; thiapylirium dye; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, distyryl carbazole skeleton or the like. Among these charge generating substances, phthalocyanine pigment and azo pigment are preferred. Among the types of phthalocyanine pigment, non-metal phthalocyanine pigment and oxotitanyl phthalocyanine pigment are preferred, and among types of azo pigment, bisazo pigment containing a fluorene ring and/or a fluorenone ring, bisazo pigment containing aromatic amine, trisazo pigment and the like are preferred. These preferred charge generating substances have high charge generating ability and are suitable for obtaining a highly-sensitive photosensitive layer. The charge generating substances may be used each alone, or two or more of them may be used in combination.

The content of the charge generating substance is not particularly limited, and preferably from 5 parts by weight to 500 parts by weight and more preferably from 10 parts by weight to 200 parts by weight, based on 100 parts by weight of the binder resin in the charge generating layer. As the binder resin for the charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, polyarylate, polyamide, and polyester. The binder resins may be used each alone or two or more of them may be used in combination.

The charge generating layer can be formed by preparing a coating solution for charge generating layer including the afore-mentioned components (the charge generating substance, the binder resin and, optionally, the plasticizer, the sensitizer, etc.) and by applying the coating solution to the surface of the conductive substrate, followed by drying. When preparing the coating solution for charge generating layer, the respective components are dissolved or dispersed in an appropriate organic solvent. The film thickness of the charge generating layer formed in this way is not particularly limited, and preferably from 0.05 μm to 5 μm and more preferably from 0.1 μm to 2.5 μm.

The charge transporting layer stacked over the charge generating layer contains as a main substance a charge transporting substance and binder resin, and optionally contains a known antioxidant, plasticizer, sensitizer, lubricant, etc. The charge transporting substance has an ability of receiving and transporting charges generated from the charge generating substance, and materials used customarily in the relevant field can be used for the charge transporting substance. The example of the materials includes: electron donating materials such as poly-N-vinylcarbazole and derivatives thereof, poly-γ-carbazolyl ethyl glutamate and derivatives thereof, pyrene-formaldehyde condensation and derivatives thereof, polyvinylpyrene, polyvinylphenanthrene, oxazole derivatives, oxadiazole derivatives, imidazole derivatives, 9-(p-diethylaminostyryl)anthracene, 1,1-bis(4-dibenzylaminophenyl)propane, styrylanthracene, styrylpyrazoline, pyrazoline derivatives, phenylhydrazone, hydrazone derivatives, triphenylamine compounds, tetraphenyldiamine compounds, triphenylmethane compounds, stilbene compounds, and azine compounds having 3-methyl-2-benzothiazoline rings; and electron accepting materials such as fluorenone derivatives, dibenzothiophene derivatives, indenothiophene derivatives, phenanthrenequinone derivatives, indenopyridine derivatives, thioxanthone derivatives, benzo[c]cinnoline derivatives, phenazine oxide derivatives, tetracyanoethylene, tetracyanoquinodimethane, bromanil, chloranil, and benzoquinone.

The charge transporting substances may be used each alone, or two or more of them may be used in combination. The content of the charge transporting substance is not particularly limited, and preferably from 10 parts by weight to 300 parts by weight and more preferably from 30 parts by weight to 150 parts by weight based on 100 parts by weight of the binder resin in the charge transporting layer.

As the binder resin for charge transporting layer, it is possible to use materials which are used customarily in the relevant field and capable of uniformly dispersing the charge transporting substance, including, for example, polycarbonate, polyarylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resin thereof. Among these materials, in view of the film forming property, and the wear resistance, the electrical property etc. of the obtained charge transporting layer, it is preferable to use polycarbonate which contains bisphenol Z as a monomer component (hereinafter referred to as "bisphenol Z polycarbonate"), and a mixture of bisphenol Z polycarbonate and other polycarbonate. The binder resins may be used each alone, or two or more of them may be used in combination.

The charge transporting layer preferably contains an antioxidant together with the charge transporting substance and the binder resin for charge transporting layer. As the antioxidant, substances used customarily in the relevant field can be used including, for example, vitamin E, hydroquinone, hindered amine, hindered phenol, paraphenylene diamine, arylalkane and derivatives thereof, organic sulfur compounds, and organic phosphorus compounds. The antioxidants may be used each alone, or two or more of them may be used in combination. The content of the antioxidant is not particularly limited, and is from 0.01% by weight to 10% by weight and preferably from 0.05% by weight to 5% by weight of the total amount of the components constituting the charge transporting layer.

The charge transporting layer can be formed by preparing a coating solution for charge transporting layer including the afore-mentioned components (the charge transporting substance, the binder resin and, optionally, the antioxidant, the plasticizer, the sensitizer, etc.) and by applying the coating solution to the surface of the charge generating layer, followed by drying. When preparing the coating solution for charge transporting layer, the respective components are dissolved or dispersed in an appropriate organic solvent. The thickness of the charge transporting layer formed in this way is not particularly limited, and preferably from 10 μm to 50 μm and more preferably from 15 μm to 40 μm.

Further, it is also possible to form a photosensitive layer in which the charge generating substance and the charge transporting substance are present in one layer. In this case, the kind and content of the charge generating substance and the charge transporting substance, the kind of the binder resin, and other additive may be the same as those in a case of forming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like as a component.

The image forming section 2 includes a charging device 12, an exposure unit 13, a developing device 14, and a cleaning unit 15. The charging device 12 and the exposure unit 13 function as a latent image forming section. The charging device 12, the developing device 14, and the cleaning unit 15 are disposed in the order just stated around the photoreceptor drum 11. The charging device 12 is disposed below the developing device 14 in the vertical direction and the cleaning unit 15.

In the image forming section 2, light corresponding to the image information is emitted from the exposure unit 13 to the surface of the photoreceptor drum 11 which has been evenly charged by the charging device 12, thereby forming an electrostatic latent image. The toner is then supplied from the developing device 14 to the electrostatic latent image, thereby forming a toner image. After the toner image is transferred to an intermediate transfer belt 25, the toner which remains on the surface of the photoreceptor drum 11 is removed by the cleaning unit 15. A series of toner image forming operations just described are repeatedly carried out.

The charging device 12 is a device that charges the surface of the photoreceptor drum 11 so as to have predetermined polarity and potential. As the charging device 12, it is possible to use a charging brush type charging device, a charger type charging device, a pin array type charging device, an ion-generating device, etc. Although the charging device 12 faces the photoreceptor drum 11 and is disposed away from the surface of the photoreceptor drum 11 longitudinally along the photoreceptor drum 11 in the embodiment, the configuration is not limited thereto. For example, a charging roller may be used as the charging device 12, and the charging roller may be disposed in pressure-contact with the photoreceptor drum. It is also possible to use a contact-charging type charging device such as a charging brush or a magnetic brush.

The exposure unit 13 is disposed so that light corresponding to each color information emitted therefrom passes between the charging device 12 and the developing device 14 and reaches the surface of the photoreceptor drum 11. As the exposure unit 13, it is possible to use a laser scanning unit having a laser-emitting section and a plurality of reflecting mirrors, for example. The other usable examples of the exposure unit 13 may include an LED array or a unit in which a liquid-crystal shutter and a light source are appropriately combined with each other.

Figure 6:
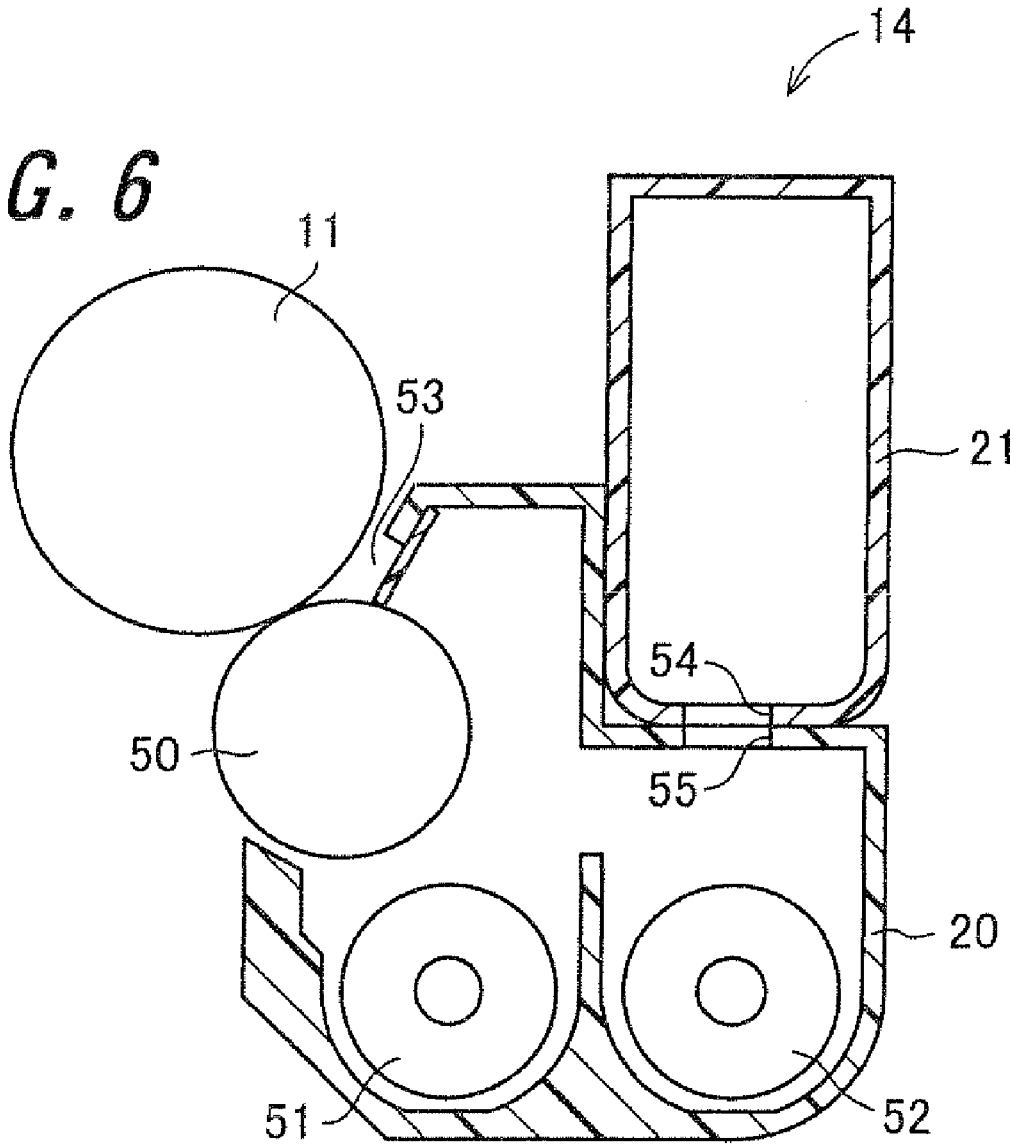
FIG. 6 is a schematic view for schematically showing a developing device provided in the image forming apparatus shown in FIG. 5.

FIG. 6 is a schematic view schematically showing the developing device 14 provided in the image forming apparatus 100 shown in FIG. 5. The developing device 14 includes a developing tank 20 and a toner hopper 21.

The developing tank 20 is a container-shaped member which is disposed so as to face the surface of the photoreceptor drum 11 and used to supply a toner to an electrostatic latent image formed on the surface of the photoreceptor drum 11. The developing tank 20 contains in an internal space thereof the toner, and stores and rotatably supports roller members such as a developing roller 50, a supplying roller 51, and an agitating roller 52. Moreover, a screw member may be stored instead of the roller-like member. The developing device 14 of this embodiment stores the toner of the afore-mentioned one embodiment in the developing tank 20 as a toner.

The developing tank 20 has an opening 53 on a side face thereof facing the photoreceptor drum 11. The developing roller 50 is provided at a position facing the photoreceptor drum 11 through the opening 53 just stated. The developing roller 50 is a roller-shaped member for supplying the toner to the electrostatic latent image on the surface of the photoreceptor drum 11 in a pressure-contact portion or most-adjacent portion between the developing roller 50 and the photoreceptor drum 11. In supplying the toner, to a surface of the developing roller 50 is applied a potential whose polarity is opposite to the polarity of the potential of the charged toner, which serves as development bias voltage. By so doing, the toner on the surface of the developing roller 50 is smoothly supplied to the electrostatic latent image. Further, an amount of the toner being supplied to the electrostatic latent image, that is, a toner attachment amount to the electrostatic latent image, can be controlled by changing a value of the development bias voltage.

The supplying roller 51 is a roller-shaped member which is rotatably disposed so as to face the developing roller 50 and used to supply the toner to the vicinity of the developing roller 50. The agitating roller 52 is a roller-shaped member which is rotatably disposed so as to face the supplying roller 51 and used to feed to the vicinity of the supplying roller 51 the toner which is newly supplied from the toner hopper 21 into the developing tank 20. The toner hopper 21 is disposed so as to communicate a toner replenishment port 54 provided on a vertically lower part of the toner hopper 21, with a toner reception port 55 provided on a vertically upper part of the developing tank 20. The toner hopper 21 replenishes the developing tank 20 with the toner according to toner consumption. Further, it may be possible to adopt a configuration such that the developing device 14 is replenished with the toner supplied directly from a toner cartridge of each color without using the toner hopper 21.

As described above, since the developing device 14 develops a latent image by using the developer of the invention, it is possible to stably form a high-definition toner image on the photoreceptor drum 11, thereby it is possible to form a high-quality image stably.

The cleaning unit 15 removes the toner which remains on the surface of the photoreceptor drum 11 after the toner image which was formed on the surface of the photoreceptor drum 11 by the developing device 14 has been transferred to a recording medium, and thus cleans the surface of the photoreceptor drum 11. In the cleaning unit 15, for example, a platy member such as a cleaning blade is used. In the image forming apparatus of the embodiment, an organic photoreceptor drum is used as the photoreceptor drum 11. A surface of the organic photoreceptor drum contains a resin component as a main ingredient and therefore tends to be degraded by chemical action of ozone which is generated by corona discharging of the charging device. The degraded surface part is, however, worn away by abrasion through the cleaning unit 15 and thus removed reliably, though gradually. Accordingly, the problem of the surface degradation caused by the ozone, etc. is solved, and it is thus possible to stably maintain the potential of charges over a long period of time. Although the cleaning unit 15 is provided in the embodiment, the cleaning unit 15 does not have to be particularly provided.

The transfer section 3 is disposed above the photoreceptor drum 11 and includes the intermediate transfer belt 25, a driving roller 26, a driven roller 27, four intermediate transfer rollers 28*b*, 28*c*, 28*m*, 28*y* corresponding to each color image information of black, cyan, magenta, and yellow, a transfer belt cleaning unit 29, and a transfer roller 30.

According to the transfer section 3, the toner image is transferred from the photoreceptor drum 11 onto the intermediate transfer belt 25 in the pressure-contact portion between the photoreceptor drum 11 and the intermediate transfer roller 28. After the transferred toner image is conveyed to a transfer nip region, the toner image is transferred onto the recording medium.

The intermediate transfer belt 25 is an endless belt which is supported around the driving roller 26 and the driven roller 27 with tension and forms a loop-shaped travel path. The intermediate transfer belt 25 rotates in a direction of an arrow B. The driving roller 26 is disposed so as to be capable of being rotated around its own axis by a drive section (not shown), and by the rotation of the driving roller 26 the intermediate transfer belt 25 rotates in the direction of the arrow B. The driven roller 27 is disposed so as to be capable of being driven to rotate by the rotation of the driving roller 26, and imparts constant tension to the intermediate transfer belt 25 so that the intermediate transfer belt 25 does not go slack. The intermediate transfer roller 28 is disposed in pressure-contact with the photoreceptor drum 11 with the intermediate transfer belt 25 interposed therebetween, and capable of being rotated around its own axis by a drive section (not shown). Further, the intermediate transfer roller 28 is connected to a power source (not shown) for applying transfer bias voltage, and transfers the toner image formed on the surface of the photoreceptor drum 11 to the intermediate transfer belt 25.

When the intermediate transfer belt 25 passes by the photoreceptor drum 11 in contact therewith, the transfer bias voltage whose polarity is opposite to the polarity of the charged toner on the surface of the photoreceptor drum 11 is applied from the intermediate transfer roller 28, with the result that the toner image formed on the surface of the photoreceptor drum 11 is transferred onto the intermediate transfer belt 25. The transferred toner image is conveyed to the transfer nip region by the rotation of the intermediate transfer belt 25 in the direction of the arrow B, where the toner image is transferred onto the recording medium. In case of a multicolor image, the toner images of respective colors formed on the respective photoreceptor drums 11 are sequentially transferred and overlaid onto the intermediate transfer belt 25, thus forming a multicolor toner image.

The transfer belt cleaning unit 29 is disposed opposite to the driven roller 27 with the intermediate transfer belt 25 interposed therebetween so as to be in contact with an outer circumferential surface of the intermediate transfer belt 25. When the intermediate transfer belt 25 contacts the photoreceptor drum 11, the toner is attached to the intermediate transfer belt 25 and may cause contamination on the recording medium, and therefore the transfer belt cleaning unit 29 removes and collects the toner on the surface of the intermediate transfer belt 25.

The transfer roller 30 is disposed in pressure-contact with the driving roller 26 with the intermediate transfer belt 25 interposed therebetween, and capable of being rotated around its own axis by a drive section (not shown). In a pressure-contact portion between the transfer roller 30 and the driving roller 26, that is, the transfer nip region, a toner image which has been borne by the intermediate transfer belt 25 and thereby conveyed to the pressure-contact portion is transferred onto a recording medium fed from the later-described recording medium feeding section 5. The recording medium onto which the toner image has been transferred is fed to the fixing section 4.

The fixing section 4 is provided downstream of the transfer section 3 along a conveyance direction of the recording medium, and contains a fixing roller 31 and a pressure roller 32. In the fixing section 4, the recording medium onto which the toner image has been transferred in the transfer section 3 is nipped by the fixing roller 31 and the pressure roller 32 so that when the recording medium passes through a fixing nip region, the toner image is heated and pressed and thereby fixed onto the recording medium. Accordingly, an image is formed.

The fixing roller 31 is disposed so as to be capable of being rotated by a drive section (not shown), and heats and fuses the toner.

Inside the fixing roller 31 is provided a heating section (not shown). The heating section heats the fixing roller 31 so that a surface of the fixing roller 31 has a predetermined temperature (hereinafter also referred to as "heating temperature"). As the heating section, a heater, a halogen lamp, and the like device can be used, for example. The heating section is controlled by a fixing condition control section mentioned below. In the vicinity of the surface of the fixing roller 31 is provided a temperature detecting sensor (not shown) which detects a surface temperature of the fixing roller 31. A result detected by the temperature detecting sensor is written in a memory portion of the control unit mentioned below.

The pressure roller 32 is disposed in pressure-contact with the fixing roller 31, and supported so as to be driven to rotate by the rotation of the fixing roller 31. The pressure roller 32 fixes the toner image onto the recording medium in cooperation with the fixing roller 31. At this time, the pressure roller 32 assists in the fixation of the toner image onto the recording medium by pressing the toner in a fused state due to heat from the fixing roller 31, against the recording medium. A pressure-contact portion between the fixing roller 31 and the pressure roller 32 is the fixing nip region.

The recording medium feeding section 5 includes an automatic paper feed tray 35, a pickup roller 36, conveying rollers 37, registration rollers 38, and a manual paper feed tray 39. In the recording medium feeding section 5, the recording medium supplied sheet by sheet from the automatic paper feed tray 35 or the manual paper feed tray 39 is fed to the transfer nip region in synchronization with the conveyance of the toner image borne on the intermediate transfer belt 25 to the transfer nip region.

The automatic paper feed tray 35 is disposed in a vertically lower part of the image forming apparatus 100 and in the form of a container-shaped member for storing the recording mediums. Examples of the recording medium include plain paper, color copy paper, sheets for overhead projector, and postcards. The pickup roller 36 takes out sheet by sheet the recording mediums stored in the automatic paper feed tray 35, and feeds the recording mediums to a paper conveyance path a1. The conveying rollers 37 are a pair of roller members disposed in pressure-contact with each other, and convey the recording medium to the registration rollers 38. The registration rollers 38 are a pair of roller members disposed in pressure-contact with each other, and feed to the transfer nip region the recording medium fed from the conveying rollers 37 in synchronization with the conveyance of the toner image borne on the intermediate transfer belt 25 to the transfer nip region.

The manual paper feed tray 39 is a device for taking recording mediums into the image forming apparatus 100. The recording mediums stored in the manual paper feed tray 39 are different from those stored in the automatic paper feed tray 35, and may have any size. The recording medium taken in from the manual paper feed tray 39 is passed through a paper conveyance path a2 by the conveying rollers 37, thereby being fed to the registration rollers 38.

The discharging section 6 includes conveying rollers 37, discharging rollers 40, and a catch tray 41. The conveying rollers 37 are disposed downstream of the fixing nip region along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus 100. The catch tray 41 stores the recording medium onto which the image has been fixed.

The image forming apparatus 100 includes a control unit (not shown). The control unit is disposed, for example, in an upper part of an internal space of the image forming apparatus 100, and contains a memory portion, a computing portion, and a control portion.

To the memory portion are input, for example, various set values obtained by way of an operation panel (not shown) disposed on the upper surface of the image forming apparatus 100, results detected from a sensor (not shown) etc. disposed in various portions inside the image forming apparatus 100, and image information obtained from an external equipment. Further, programs for operating various functional elements are written. Examples of the various functional elements include a recording medium determining section, an attachment amount control section, and a fixing condition control section. As the memory portion, those customarily used in the relevant field can be used including, for example, a read only memory (ROM), a random access memory (RAM), and a hard disk drive (HDD). As the external equipment, it is possible to use electrical and electronic devices which can form or obtain the image information and which can be electrically connected to the image forming apparatus 100, and examples thereof include a computer, a digital camera, a television receiver, a video recorder, a DVD recorder, an HD DVD, a Blu-ray disc recorder, a facsimile machine, and a personal digital assistant.

The computing portion takes out the various data (such as an image formation order, the detected result, and the image information) written in the memory portion and the programs for the various functional elements, and then makes various determinations.

The control portion sends to a relevant device a control signal in accordance with the result determined by the computing portion, thus performing control on operations. The control portion and the computing portion include a processing circuit which is achieved by a microcomputer, a microprocessor and the like having a central processing unit (CPU). The control unit contains a main power source as well as the afore-mentioned processing circuit. The power source supplies electricity to not only the control unit but also respective devices provided inside the image forming apparatus 100.

By forming an image with such an image forming apparatus 100, it is possible to stably form an image with high definition and high image quality without unevenness in density.

EXAMPLES

Hereinafter, description for the invention will be given specifically with showing examples and comparative examples. Hereinafter, "part" and "%" mean "part by weight" and "% by weight" respectively, unless otherwise specified. The glass transition temperature, the softening temperature, the volume average particle size of the fine resin particle are measured as follows.

[Glass Transition Temperature of Fine Resin Particle]

Using a differential scanning calorimeter (trade name: DSC220, manufactured by Seiko Instruments & Electronics Ltd.), 1 g of specimen was heated at a temperature increasing rate of 10° C./min to measure a DSC curve based on Japanese Industrial Standards (JIS) K7121-1987. A temperature at an intersection of a straight line that was extended toward a low-temperature side from a base line on the high-temperature side of an endothermic peak corresponding to glass transition of the obtained DSC curve and a tangent line that was drawn on a point where a gradient thereof was maximum against a curve extending from a rising part to a top of the peak was regarded as the glass transition temperature (Tg).

[Softening Temperature of Fine Resin Particle]

Using a flow characteristic evaluation apparatus (trade name: FLOW TESTER CFT-100C, manufactured by Shimadzu Corporation), 1 g of specimen was heated at a temperature increasing rate of 6° C./min, and a load of 20 kgf/cm$^2$ ($19.6\times10^5$ Pa) is applied thereto. A temperature at the time when a half-amount of the specimen was pushed out of a dye (nozzle opening diameter of 1 mm and length of 1 mm) was obtained as the softening temperature (Tm).

[Volume Average Particle Size]

To 50 ml of electrolyte (trade name: ISOTON-II, manufactured by Beckman Coulter, Inc.), 20 mg of specimen and 1 ml of sodium alkylether sulfate were added, and a thus-obtained mixture was subjected to dispersion processing by an ultrasonic distributor (trade name: desktop two-frequency ultrasonic cleaner VS-D100, manufactured by AS ONE Corporation) for three minutes at an ultrasonic frequency of 20 kHz, thereby preparing a measurement sample. The measurement sample was analyzed by a particle size distribution-measuring device: MULTISIZER III (trade name, manufactured by Beckman Coulter, Inc.) under the conditions where an aperture diameter was 100 μm and the number of particles for measurement was 50,000 counts. A volume particle size distribution of the sample particles was thus obtained from which the volume average particle size was then determined.

Example 1

Carrier Base Particle Arranging Step S1

For a carrier base particle, Mn—Mg ferrite (manufactured by Dowa Iron Powder Co., Ltd.; saturated magnetization of 65 emu/g and average particle size of 40 μm) was used.

[Fine Resin Particle Preparing Step S2]

Styrene and butyl acrylate were polymerized to be freeze-dried and as fine resin particles, styrene butyl acrylate copolymer fine particles (glass transition temperature of 95° C. and softening temperature of 183° C.) with a volume average particle size of 0.2 μm were obtained.

[Coating Material Preparing Step S3]

With a Henschel mixer (trade name: FM20C, manufactured by Mitsui Mining Co., Ltd.), 2 parts of the fine resin particles described above and 0.1 part of a carbon black (manufactured by Cabot Japan K.K.), and 0.02 part of a charge control agent (trade name: LR-147, manufactured by Japan Carlit Co., Ltd.) were mixed to prepare a coating material.

[Coating Step S4]

By an apparatus in which a two-fluid nozzle is installed in Hybridization system (trade name: NHS-1 Model, manufactured by Nara Machinery Co., Ltd.) in conformity with the apparatus shown in FIG. 2, 100 parts of the carrier base particles and 2.12 parts of the coating materials are brought to be a state of being stirred and fluidized, and ethanol is sprayed thereto as the liquid.

As the liquid spraying unit, a commercially-available product is able to be used, and the one connected, for example, so as to quantitatively feed the liquid to a two-fluid nozzle (trade name: HM-6 Model, manufactured by Fuso Seiki Co., Ltd.) through a liquid feeding pump (trade name: SP11-12, manufactured by FLOM Co., Ltd.) is able to be used. The spraying speed of liquid and the exhausting speed of liquid gas are able to be monitored by a commercially-available gas detector (trade name: XP-3110, manufactured by New Cosmos Electric Co., Ltd.). The temperature regulation jacket was provided over the entire surface of the powder flowing section and the wall surface of the stirring section. In the powder passage, a temperature sensor was installed.

At the coating material adhering step onto the surface of the carrier base particles, peripheral speed in the outermost periphery of the Hybridization system was set to 20 m/sec, and the temperature in the powder flowing section and the stirring section were regulated to 40° C.

At the spraying step and the film-forming step, the peripheral speed is set to 30 m/sec, and the temperature in the powder flowing section and the stirring section were regulated to 80° C. Additionally, an installation angle of the two-fluid nozzle was set so that an angle formed by the liquid spraying direction and the powder flowing direction (hereinafter, referred to as "spraying angle") is in parallel (0°).

With such an apparatus, to the particles stirred and fluidized, ethanol is sprayed for 20 minutes at a spraying speed of 1 g per minute and at an air flow rate of 5 L per minute, and film-forming of the coating material on the surfaces of the carrier base particles was performed. Then, spraying of ethanol is stopped and stirring is performed for 10 minutes and a carrier of Example 1 was obtained.

At this time, exhaust concentration of ethanol exhausted through a through-hole and the gas exhausting section was changed depending on supplying time and reduced by stopping the supply. Moreover, as a flow rate of the air flowed into the apparatus, the flow rate of the air flowed into the apparatus from the rotating shaft section is adjusted to 5 L per minute and set to 10 L per minute adding the flow rate of the air from the two-fluid nozzle.

Example 2

A carrier of Example 2 was obtained in the same manner as Example 1 except that at the coating material preparing step, the charge control agent was not added but instead, at the coating step, one that the charge control agent was dissolved in the ethanol to be sprayed was used.

Example 3

A carrier of Example 3 was obtained in the same manner as Example 1 except that at the coating material preparing step, the charge control agent was not added.

Example 4

A carrier of Example 4 was obtained in the same manner as Example 1 except that at the film-forming step, the temperatures in the powder flowing passage and the stirring section were not regulated.

Comparative Example 1

A carrier of Comparative Example 1 was obtained in the same manner as Example 1 except that at the film-forming step, spraying of ethanol was not performed. After finishing the coating step, adhesion of powders in black to gray was often seen.

Evaluations for charging stability and carrier adhesion were performed as follows concerning carriers of Examples and Comparative Example.

Into a stirring container made of polyethylene, 8 parts of a toner and 92 parts of a carrier were inputted to be stirred for 1 hour at a speed of 200 rpm on a polyethylene container rotating platform of twin-shaft driving, and a two-component developer whose toner density is 8% was obtained.

<Aging Conditions>

Using the two-component developer produced under the above-described conditions, a digital full-color multi-functional peripheral MX-6200N (printing speed: color, 41 ppm, monochrome, 62 ppm) manufactured by Sharp Corporation was used to continuously print an image whose printing rate is 5%. Furthermore, a gap between a developer bearing member and a developer regulating member, and a gap between the developer bearing member and the image bearing member in the developing area, are set to 0.4 mm. At first, idling is performed for 3 minutes, and the above-described two-component developer was prepared in the developer tank.

A direct current bias voltage value of a bias voltage to be applied to the developer bearing member is changed as appropriate depending on the charging amount of the toner in each developer, and adjusted so that the image density of a solid image became a defined value. A potential difference between a potential of a non-image part on the image bearing member and that of the developer bearing member was 200 V.

A toner consuming amount by visible image formation is detected by a toner density sensor as changes in toner density. Since the amount of the toner consumed is replenished from the toner hopper until reaching to the defined toner density, the toner density in the two-component developer inside the developing unit is maintained to be approximately constant.

<Charging Stability>

Aging tests were performed under the above-described conditions, and the toner charging amount at printing sheets of 0 k sheets and 5 k sheets was measured.

The charging stability was evaluated as to how much the charging amount was decreased compared with that at the time of printing sheets of 0 k.

Evaluation standards are as follows.

Excellent: Very favorable. Reduction in the charging amount is 5 μC/m or less.

Good: Favorable. Reduction in the charging amount is above 5 μC/m and 10 μC/m or less.

Not Bad: No problem in practical use. Reduction in the charging amount is above 10 μC/m and 15 μC/m or less.

Poor: No Good. Reduction in the charging amount is above 15 μC/m.

<Carrier Adhesion>

Next, as to the carriers which the charging amount thereof was measured, the adhered number of carriers after finishing printing of 5 k sheets was measured. Development is performed by applying a voltage of 200 V, and measured results of the adhered number of carriers in a fixed area (297 mm×24 mm) in the non-image part on the image bearing member is shown in Table 1. Depending on the adhered number of carriers, evaluations were performed at the standards as follows.

Excellent: Very favorable. The adhered number of carriers is 5 pieces or less.

Good: Favorable. The adhered number of carriers is 6 to 20 pieces.

Not Bad: No problem in practical use. The adhered number of carriers is 21 to 40 pieces.

Poor: No Good. The adhered number of carriers is 41 pieces or more.

<Comprehensive Evaluation>

Based on the evaluations of the charging stability and the carrier adhesion described above, comprehensive evaluations were performed. As the comprehensive evaluations, among the evaluations of the charging stability and the carrier adhesion, either worse one was adopted. The result of C and above was judged to be usable.

The evaluation results and comprehensive evaluation results of carriers obtained in the examples and the comprehensive examples are shown in Table 1.

TABLE 1

| | Charging stability | | | | Carrier adhesion | | |
|---|---|---|---|---|---|---|---|
| | Charging amount [−μC/g] | | | | Number of | | Comprehensive |
| | 0K | 5K | Difference | Evaluation | pieces | Evaluation | Evaluation |
| Example 1 | 24.5 | 18.2 | 6.3 | Good | 13 | Good | Good |
| Example 2 | 22.3 | 17.7 | 4.6 | Excellent | 7 | Good | Good |
| Example 3 | 28.6 | 14.4 | 14.2 | Not Bad | 2 | Excellent | Not Bad |
| Example 4 | 23.7 | 15.8 | 7.9 | Good | 29 | Not Bad | Not Bad |
| Comparative Example 1 | 26.5 | 14 | 12.5 | Not Bad | 41 | Poor | Poor |

As to the carriers of Examples 1 and 2, good evaluation results were obtained for the charging stability and the carrier adhesion. In Example 2, is considered that since the charge control agent is existed many in the vicinity of the surface of the coating film, further improvement of the chargeability is realized. Furthermore, when the results of Examples 1 to 3 are compared, in Examples 1 and 2 in which the charge control agent is introduced into the coating material, there is a tendency of more deterioration in carrier adhesion than Example 3 which the agent is not introduced. This is considered to be caused since the charge control agent has the conductivity and gives a bad influence to the coating film formation. Moreover, although spraying of ethanol prevents decrease of the chargeability, this is considered to be caused since an effect is included such that the charge control agent is spread on the coating film to be introduced into the film.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing a resin-layer coated carrier in which the resin-layer coated carrier is manufactured by stirring magnetic base particles and fine resin particles in a powder passage by using a manufacturing apparatus provided with a rotary stirring section including a rotary disc circumferentially provided with a stirring blade and a rotary shaft and the powder passage including a rotary stirring chamber and a circulation tube, comprising:

a fine resin particle adhering step of inputting the magnetic base particles and the fine resin particles into the powder passage with the rotary stirring section rotating, and adhering the fine resin particles onto a surface of the magnetic base particle;

a spraying step of spraying at least a liquid that plasticizes the fine resin particles with spray gas from a spraying section, on the magnetic base particle and the fine resin particle which are in a fluidized state in the powder passage by rotation of the rotary stirring section; and a film-forming step of continuing rotation by the rotary stirring section to fluidize the magnetic base particles and the fine resin particles until the fine resin particles adhered to the magnetic base particles are softened to form a film.

2. The method of claim 1, wherein temperatures in the powder passage and the rotary stirring section are regulated by a temperature regulation section provided in at least a part of the powder passage so that the temperature in the powder passage is regulated to a predetermined temperature.

3. The method of claim 1, wherein, in the powder passage configured by connecting the circulation tube at one end and another end thereof to an inlet and an outlet of the rotary stirring chamber, respectively, the magnetic base particles and the fine resin particles are repeatedly circulated by the rotary stirring section.

4. The method of claim 1, wherein the rotary disc included in the rotary stirring section rotates with rotation of the rotary shaft so that the magnetic base particles and the fine resin particles being in a fluidized state are collided with the rotary disc being rotating.

5. The method of claim 1, wherein the spray gas is exhausted to an outside of the powder passage together with the gasified liquid in the powder passage.

6. The method of claim 1, wherein the liquid that plasticizes the fine resin particles contains at least a polar solvent.

7. The method of claim 1, wherein the liquid that plasticizes the fine resin particles dissolves an additive component of the coating material.

8. The method of claim 7, wherein the additive component is a charge control agent containing a polar component.

9. A resin-layer coated carrier which is manufactured by the method of manufacturing a carrier of claim 1.

10. A developer comprising the resin-layer coated carrier of claim 9.

11. A developer comprising the resin-layer coated carrier of claim 9 and a toner, thereby constituting a two-component developer.

12. A developing device that performs development of a latent image formed on an image bearing member by using the developer of claim 11 to form a toner image.

13. An image forming apparatus comprising:

an image bearing member on which a latent image is to be formed;

a latent image forming section that forms a latent on the image bearing member; and the developing device of claim 12.

* * * * *